US005342750A

United States Patent [19]

Sasaki et al.

[11] Patent Number: 5,342,750

[45] Date of Patent: Aug. 30, 1994

[54] SILVER HALIDE PHOTOGRAPHIC MATERIAL CONTAINING A TELLURIUM COMPOUND

[75] Inventors: Hirotomo Sasaki; Toru Fujimori; Hiroyuki Mifune; Kimiyasu Morimura, all of Kanagawa, Japan

[73] Assignee: Fuji Photo Film Co., Ltd., Kanagawa, Japan

[21] Appl. No.: 51,691

[22] Filed: Apr. 23, 1993

[30] Foreign Application Priority Data

Apr. 24, 1992 [JP] Japan ..... 4-129787

[51] Int. Cl.[5] ..... G03C 1/06; G03C 1/005; G03C 1/494

[52] U.S. Cl. ..... 430/603; 430/575; 430/600; 430/608; 430/613; 430/611

[58] Field of Search ..... 430/489, 575, 600, 603, 430/607, 608, 611, 613, 614

[56] References Cited

U.S. PATENT DOCUMENTS

| | | | |
|---|---|---|---|
| 1,678,832 | 7/1928 | Sheppard | 430/600 |
| 3,501,313 | 3/1970 | Willems et al. | 430/600 |
| 3,772,031 | 11/1973 | Berry et al. | 430/603 |
| 4,521,508 | 6/1985 | Sugimoto et al. | 430/603 |
| 4,607,000 | 8/1986 | Gunther et al. | 430/612 |
| 4,607,001 | 8/1986 | Lok et al. | 430/489 |
| 4,861,703 | 8/1989 | Lok et al. | 430/608 |
| 4,923,794 | 3/1990 | Sasaki et al. | 430/603 |
| 5,028,522 | 7/1991 | Kojima et al. | 430/607 |
| 5,215,880 | 6/1993 | Kojima et al. | 430/600 |
| 5,217,859 | 6/1993 | Boettcher et al. | 430/608 |
| 5,219,721 | 6/1993 | Klaus et al. | 430/607 |
| 5,273,874 | 12/1993 | Kojima et al. | 430/603 |

FOREIGN PATENT DOCUMENTS

| | | | |
|---|---|---|---|
| 1289082 | 5/1961 | France | 430/608 |
| 4271341 | 9/1992 | Japan . | |
| 511385 | 1/1993 | Japan . | |
| 5027355 | 2/1993 | Japan | 430/608 |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A silver halide photographic material comprises a silver halide emulsion layer provided on a support. In the photographic material of the present invention, the silver halide emulsion layer contains a tellurium compound represented by the formula (I) or (II):

(I) (II)

in which each of $R^{11}$ and $R^{12}$ is $-OR^{13}$, $-NR^{14}R^{15}$, $-SR^{16}$ or hydrogen; $R^{11}$ and $R^{12}$ may be combined with each other to form a heterocyclic ring; each of $R^{21}$ and $R^{22}$ is an alkyl, alkenyl, alkynyl, aralkyl, aryl or heterocyclic group, $-OR^{23}$, $-NR^{24}R^{25}$, $-SR^{26}$ or hydrogen; $R^{21}$ and $R^{22}$ may be combined with each other to form a heterocyclic ring; each of $X^1$ and $X^2$ is oxygen, sulfur or $=NR^{17}$; each of $X^3$ and $X^4$ is oxygen, sulfur or $=NR^{27}$; each of $R^{13}$, $R^{14}$, $R^{15}$, $R^{16}$, $R^{17}$, $R^{23}$, $R^{24}$, $R^{25}$, $R^{26}$ and $R^{27}$ is an alkyl, alkenyl, alkynyl, aralkyl, aryl or heterocyclic group or hydrogen; $R^{14}$ and $R^{15}$ may be combined with each other to form a heterocyclic ring; and $R^{24}$ and $R^{25}$ may be combined with each other to form a heterocyclic ring.

17 Claims, No Drawings

SILVER HALIDE PHOTOGRAPHIC MATERIAL CONTAINING A TELLURIUM COMPOUND

FIELD OF THE INVENTION

The present invention relates to a silver halide photographic material and a process for tellurium sensitization of a silver halide emulsion.

BACKGROUND OF THE INVENTION

A silver halide photographic material comprises a silver halide emulsion layer provided on a support. The silver halide emulsion is usually chemically sensitized to obtain a desired sensitivity or gradation. Examples of the chemical sensitizer include a sulfur sensitizer, a selenium sensitizer, a tellurium sensitizer, a noble metal (such as gold) sensitizer, a reduction sensitizer and a combination thereof.

For several years there has been a growing demand for improvement of silver halide photography. The recent photographic material requires very high sensitivity. Further, an improvement of the graininess and the sharpness has been required with respect to the formed image. A rapid image forming process such as a quick development process is also required. The sensitization and the sensitizer have been improved to meet these requirements.

Tellurium sensitizers are disclosed in U.S. Pat. Nos. 1,574,944, 1,623,499, 3,320,069, 3,531,289, 3,655,394, 3,772,031, 4,704,349, British Patents No. 235,211, 1,121,496, 1,295,462, 1,396,696, Canadian Patent No. 800,958, Japanese Patent Provisional Publications No. 53(1978)-57817, No. 61(1986)-20940 and No. 61(1986)-67845.

Some tellurium compounds have been used as additives of a photographic material such as antifogging agents. The tellurium compounds other then the sensitizers are disclosed in U.S. Pat. Nos. 4,607,000, 4,607,001, Japanese Patent Provisional Publications No. 62(1987)-234153, No. 63(1988)-65438, No. 2(1990)-118566, No. 2(1990)-140736, No. 2(1990)-158730 and No. 3(1991)-91735.

The tellurium sensitizers such as colloidal tellurium and potassium telluride disclosed in Canadian Patent No. 800,958 are excellent in sensitivity, compared with conventional sulfur sensitizers. However, the colloidal tellurium is poor in reproducibility, since the quality of the colloidal tellurium is greatly influenced by the conditions in synthesis. For example, the colloidal tellurium is prepared by using a strong reducing agent such as stannous chloride. A trace amount of the reducing agent which remains after synthesis influences the quality of the colloidal tellurium. Further, potassium telluride is also poor in reproducibility. Moreover, it is rather difficult to handle potassium telluride, since it is not a stable compound.

Tellurium compounds are generally not stable. Accordingly, it is difficult to reproduce a photographic property when a tellurium compound is used in a photographic material. A tellurium sensitizer demands an excellent reproducibility and stability.

By the way, a silver halide photographic emulsion is usually spectrally sensitized with a sensitizing dye. Silver halide inherently has a blue sensitivity. The spectral sensitivity is changed by a sensitizing dye to the other light regions such as green, red or infrared regions.

The spectral sensitivity is preferably as strong as possible. Even if a large amount of the sensitizing dye is used, the spectral sensitivity is not so increased as is expected. This phenomenon is called inherent desensitization. It is particularly remarkable within a long wavelength region. The inherent desensitization is a result of development inhibition or latent image diffusion caused by the dye and invalidity of photoelectron or latent image bleaching caused by a positive hole of the dye.

If a large amount of the sensitizing dye is used, the sensitivity of a photographic material is not stable. The sensitivity is usually decreased, while the photographic material is preserved.

Therefore, an improvement is required to increase steadily the spectral sensitivity of a photographic material.

Furthermore, a rapid image forming process such as a quick development process has recently been particularly required.

SUMMARY OF THE INVENTION

An object of the present invention is to provide a silver halide photographic material sensitized with a tellurium compound, which is improved in reproducibility, stability and sensitivity.

Another object of the invention is to provide a silver halide photographic material which has a high spectral sensitivity.

A further object of the invention is to provide a silver halide photographic material having a high sensitivity and a high developing speed, which material is advantageously used in a rapid image forming process.

There is provided by the present invention a silver halide photographic material which comprises a silver halide emulsion layer provided on a support, wherein the silver halide emulsion layer contains a tellurium compound represented by the formula (I):

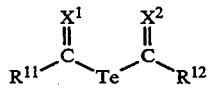

(I)

in which each of $R^{11}$ and $R^{12}$ independently is $—OR^{13}$, $—NR^{14}R^{15}$, $—SR^{16}$ or hydrogen; $R^{11}$ and $R^{12}$ may be combined with each other to form a heterocyclic ring; each of $X^1$ and $X^2$ independently is oxygen, sulfur or $=NR^{17}$; each of $R^{13}$, $R^{14}$, $R^{15}$, $R^{16}$ and $R^{17}$ independently is an alkyl group, an alkenyl group, an alkynyl group, an aralkyl group, an aryl group, a heterocyclic group or hydrogen; $R^{14}$ and $R^{15}$ may be combined with each other to form a heterocyclic ring; and each of the alkyl group, the alkenyl group, the alkynyl group, the aralkyl group, the aryl group and the heterocyclic group may have one or more substituent groups.

There is also provided by the invention a silver halide photographic material which comprises a silver halide emulsion layer provided on a support, wherein the silver halide emulsion layer contains a tellurium compound represented by the formula (II):

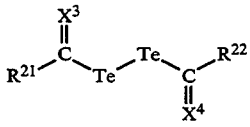

(II)

in which each of $R^{21}$ and $R^{22}$ independently is an alkyl group, an alkenyl group, an alkynyl group, an aralkyl group, an aryl group, a heterocyclic group, —$OR^{23}$, —$NR^{24}R^{25}$, —$SR^{26}$ or hydrogen; $R^{21}$ and $R^{22}$ may be combined with each other to form a heterocyclic ring; each of $X^3$ and $X^4$ independently is oxygen, sulfur or =$NR^{27}$; each of $R^{23}$, $R^{24}$, $R^{25}$, $R^{26}$ and $R^{27}$ independently is an alkyl group, an alkenyl group, an alkynyl group, an aralkyl group, an aryl group, a heterocyclic group or hydrogen; $R^{24}$ and $R^{25}$ may be combined with each other to form a heterocyclic ring; and each of the alkyl group, the alkenyl group, the alkynyl group, the aralkyl group, the aryl group and the heterocyclic group may have one or more substituent groups.

The tellurium compound represented by the formula (I) or (II) is preferably used in a process for tellurium sensitization of a silver halide emulsion, wherein the silver halide emulsion is sensitized with a tellurium compound.

The present inventors found a new tellurium sensitizer represented by the formula (I) or (II). The tellurium compound has an excellent sensitizing function. Further, the function of the tellurium sensitizer is stable, and is excellent in reproducibility. Accordingly, the silver halide photographic material of the present invention is improved in reproducibility, stability and sensitivity.

The inventors have further noted that the tellurium compound has another function of improving the spectral sensitivity of a sensitizing dye. Therefore, the photographic material of the invention has a high spectral sensitivity.

Furthermore, the inventors note that the photographic material of the present invention shows a high developing speed. Accordingly, the photographic material is advantageously used in a rapid image forming process.

DETAILED DESCRIPTION OF THE INVENTION

The silver halide photographic material of the present invention is characterized in that the silver halide emulsion layer contains a tellurium compound represented by the formula (I) or (II).

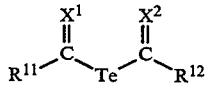

(I)

In the formula (I) , each of $R^{11}$ and R12 independently is —$OR^{13}$, $NR^{14}R^{15}$, —$SR^{16}$ or hydrogen. Each of $R^{11}$ and $R^{12}$preferably is —$OR^{13}$ or —$NR^{14}R^{15}$, and more preferably is —$NR^{14}R^{15}$. In the formula (I) , $R^{11}$ and $R^{12}$ preferably are the same group. $R^{11}$ and $R^{12}$ may be combined with each other to form a heterocyclic ring.

Each of $X^1$ and $X^2$ independently is oxygen, sulfur or =$NR^{17}$, preferably is oxygen or sulfur, and more preferably is oxygen.

Each of $R^{13}$, $R^{14}$, $R^{15}$, $R^{16}$ and $R^{17}$ independently is an alkyl group, an alkenyl group, an alkynyl group, an aralkyl group, an aryl group, a heterocyclic group or hydrogen, and preferably is an alkyl group, an aryl group or a heterocyclic group. $R^{14}$ and $R^{15}$ may be combined with each other to form a heterocyclic ring.

The alkyl group, the alkenyl group, the alkynyl group and the alkyl moiety of the aralkyl group may have any of straight, branched and cyclic structures.

The alkyl group preferably has 1 to 30 carbon atoms, and more preferably has 1 to 20 carbon atoms. Examples of the alkyl groups include methyl, ethyl, n-propyl, isopropyl, t-butyl, n-octyl, n-decyl, n-hexadecyl, cyclopentyl and cyclohexyl.

The alkenyl group preferably has 2 to 30 carbon atoms, and more preferably has 2 to 20 carbon atoms. Examples of the alkenyl groups include allyl, 2-butenyl and 3-pentenyl.

The alkynyl group preferably has 2 to 30 carbon atoms, and more preferably has 2 to 20 carbon atoms. Examples of the alkynyl groups include propargyl and 3-pentynyl.

The aralkyl group preferably has 7 to 30 carbon atoms, and more preferably has 7 to 20 carbon atoms. Examples of the aralkyl groups include benzyl and phenethyl.

The aryl group preferably has 6 to 30 carbon atoms, and more preferably has 6 to 20 carbon atoms. Examples of the aryl groups include phenyl and naphthyl.

The heterocyclic group preferably has a three-membered to ten-membered heterocyclic ring, and more preferably has a five-membered or six-membered ring. At least one of the hereto atom contained in the ring preferably is nitrogen, oxygen or sulfur. The heterocyclic ring may be condensed with another heterocyclic ring or an aromatic ring. The ring may be either saturated or unsaturated. Examples of the heterocyclic groups include pyridyl, imidazolyl, quinolyl, benzimidazolyl, pyrimidyl, pyrazolyl, isoquinolinyl, thiazolyl, thienyl, furyl, benzothiazolyl, morpholino, morpholinyl, piperidyl, piperazyl, piperazinyl and pyrrolidinyl.

The alkyl group, the alkenyl group, the alkynyl group, the aralkyl group, the aryl group and the heterocyclic group may have one or more substituent groups.

Examples of the substituent groups include a halogen atom (e.g., fluorine, chlorine, bromine), an alkyl group (e.g., methyl, ethyl, n-propyl, isopropyl, t-butyl, n-octyl, cyclopentyl, cyclohexyl), an alkenyl group allyl, 2-butenyl, 3-pentenyl), an alkynyl group (e.g., propargyl, 3-pentynyl), an aralkyl group (e.g., benzyl, phenethyl), an aryl group (e.g., phenyl, naphthyl, p-tolyl), a heterocyclic group (e.g., pyridyl, furyl, imidazolyl, piperidyl, morpholino), an alkoxy group (e.g., methoxy, ethoxy, butoxy), an aryloxy group (e.g., phenoxy, naphthoxy), amino, a substituted amino group (e.g., dimethylamino, ethylamino, anilino), an amido group (e.g., acetamido, benzamido), ureido, a substituted ureido group (e.g., N-methylureido, N-phenyluredio), an alkoxycarbonylamino group (e.g., methoxycarbonylamino), an aryloxycarbonylamino group (e.g., phenoxycarbonylamino), an alkylsulfonylamino group (e.g., methanesulfonylamino), an arylsulfonylamino group (e.g., benzenesulfonylamino), carbamoyl, a substituted carbamoyl group (e.g., diethylcarbamoyl, phenylcarbamoyl), an alkylsulfonyl group (e.g., methanesulfonyl), an arylsulfonyl group (e.g., benzenesulfonyl), an alkylsulfinyl group (e.g., methanesulfinyl), an arylsulfinyl group (e.g., benzenesulfinyl), an alkoxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoric amido group (e.g., N,N-diethylphosphoric amido), an alkylthio group (e.g., methylthio, ethylthio), an arylthio group (e.g., phenylthio), cyano, sulfo, carboxyl, hydroxyl, phosphono, nitro and an ammonio group (e.g., trimethylammonio).

The substituent groups may be further substituted with another group. Two or more substituent groups may be different from each other.

A preferred tellurium compound is represented by the formula (I-a).

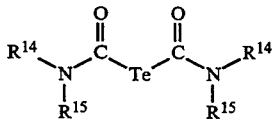

(I-a)

In the formula (I-a), the definitions of $R^{14}$ and $R^{15}$ are the same as those defined in the formula (I). The two groups of $R^{14}$ or $R^{15}$ may be different from each other.

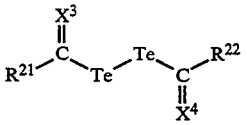

(II)

In the formula (II), each of $R^{21}$ and $R^{22}$ independently is an alkyl group, an alkenyl group, an alkynyl group, an aralkyl group, an aryl group, a heterocyclic group, $—OR^{23}$, $—NR^{24}R^{25}$, $—SR^{26}$ or hydrogen, preferably is $—OR^{23}$, $—NR^{24}R^{25}$, $—SR^{26}$ or hydrogen, more preferably is $—OR^{23}$ or $—NR^{24}R^{25}$, and most preferably is $—NR^{24}R^{25}$. In the formula (II), $R^{21}$ and $R^{22}$ preferably are the same group. $R^{21}$ and $R^{22}$ may be combined with each other to form a heterocyclic ring.

Each of $X^3$ and $X^4$ independently is oxygen, sulfur or $=NR^{27}$, preferably is oxygen or sulfur, and more preferably is oxygen.

Each of $R^{23}$, $R^{24}$, $R^{25}$, $R^{26}$ and $R^{27}$ independently is an alkyl group, an alkenyl group, an alkynyl group, an aralkyl group, an aryl group, a heterocyclic group or hydrogen, and preferably is an alkyl group, an aryl group or a heterocyclic group. $R^{24}$ and $R^{25}$ may be combined with each other to form a heterocyclic ring.

The definitions and the substituent groups of the above-mentioned alkyl, alkenyl, alkynyl, aralkyl, aryl and heterocyclic groups are the same as those defined and described in the formula (I).

A preferred tellurium compound is represented by the formula (II-a).

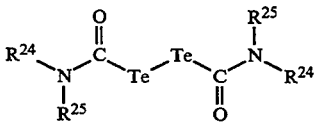

(II-a)

In the formula (II-a), the definitions of $R^{24}$ and $R^{25}$ are the same as those defined in the formula (II). The two groups of $R^{24}$ or $R^{25}$ may be different from each other.

Examples of the tellurium compounds represented by the formulas (I) and (II) are shown below.

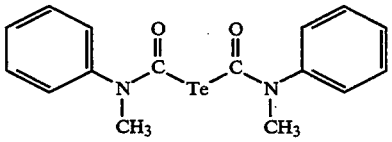

(I-1)

-continued

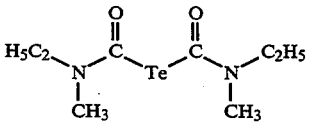

(I-2)

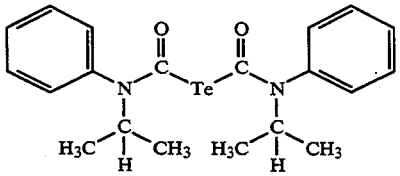

(I-3)

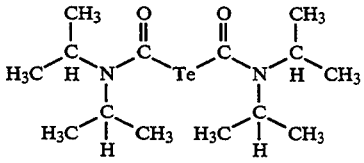

(I-4)

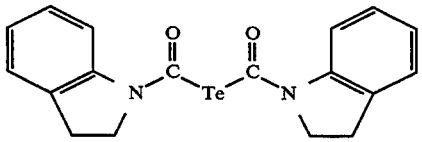

(I-5)

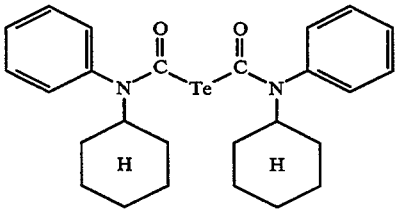

(I-6)

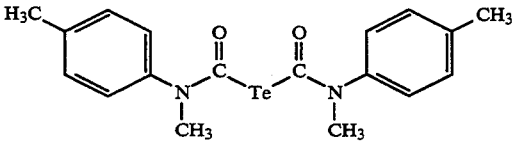

(I-7)

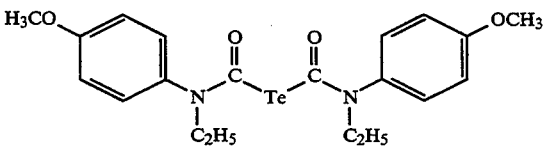

(I-8)

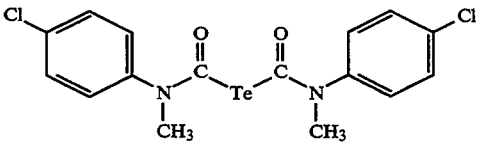

(I-9)

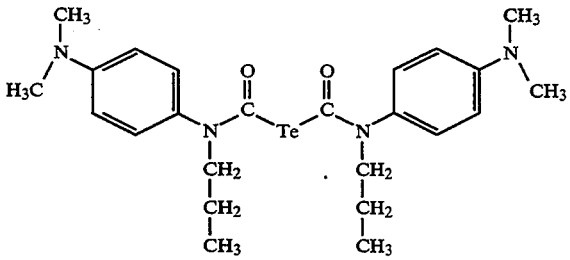

(I-10)

-continued
(I-11)
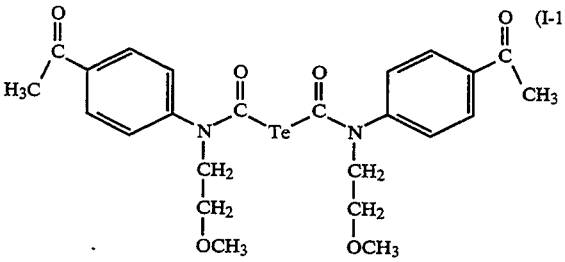
(I-12)
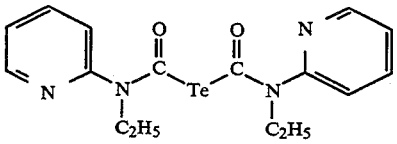
(I-13)
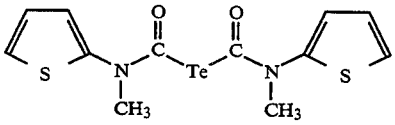
(I-14)
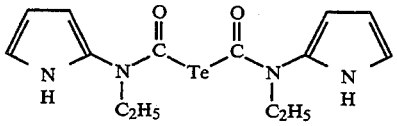
(I-15)
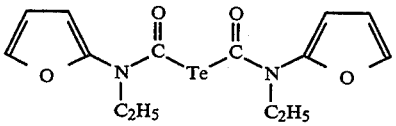
(I-16)
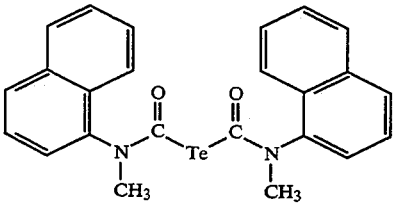
(I-17)
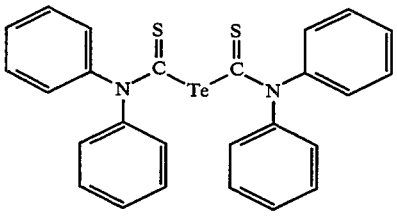
(I-18)
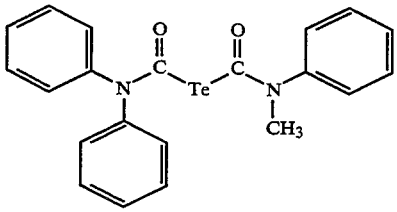
(I-19)
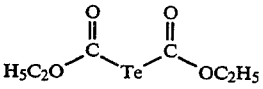
-continued
(I-20)
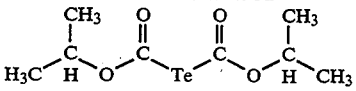
(I-21)
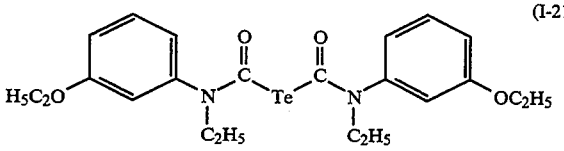
(I-22)
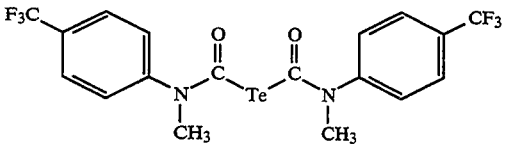
(I-23)
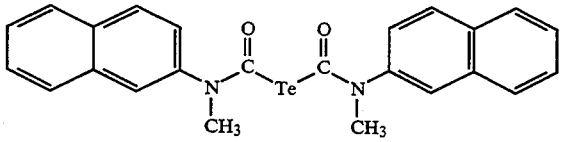
(I-24)
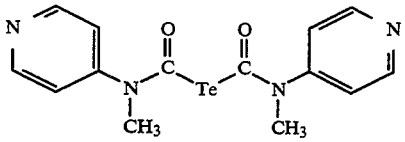
(I-25)
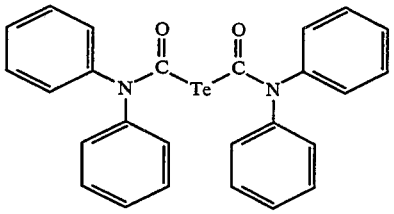
(I-26)
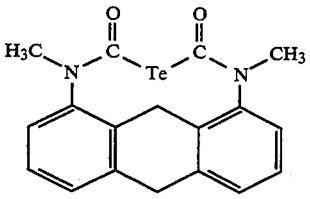
(I-27)
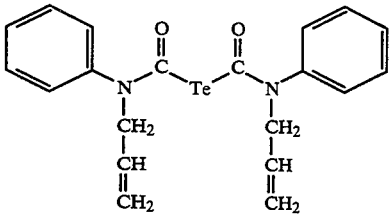
(I-28)
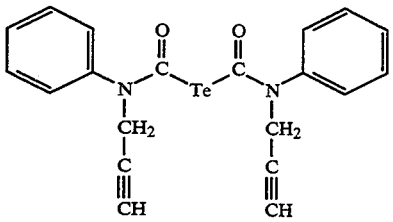

-continued (I-29)

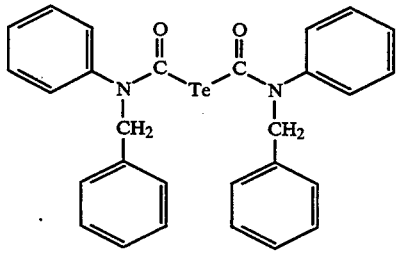

(I-30)

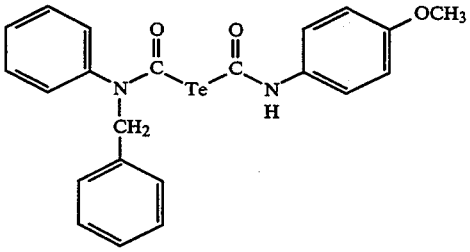

(I-31)

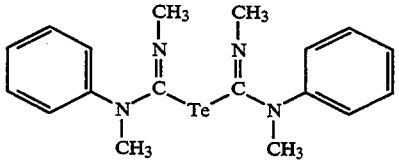

(II-1)

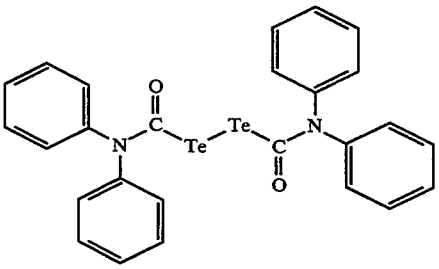

(II-2)

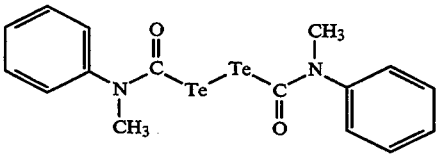

(II-3)

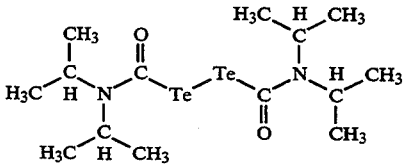

(II-4)

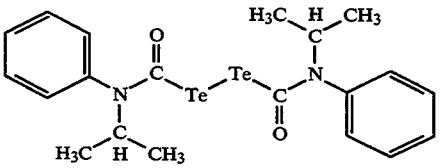

-continued (II-5)

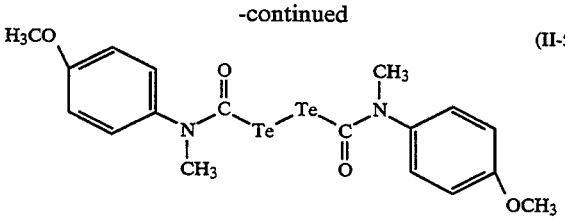

(II-6)

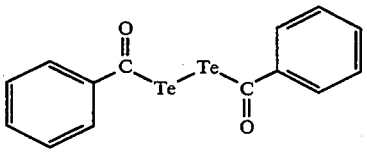

(II-7)

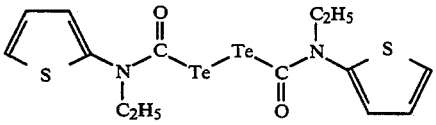

(II-8)

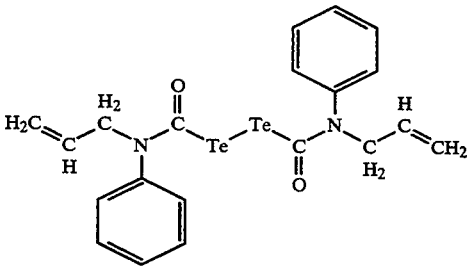

(II-9)

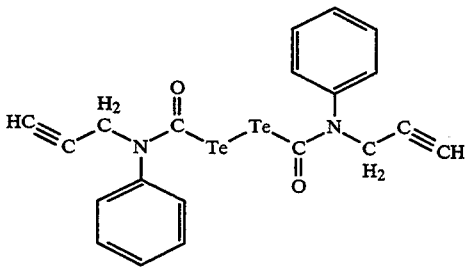

(II-10)

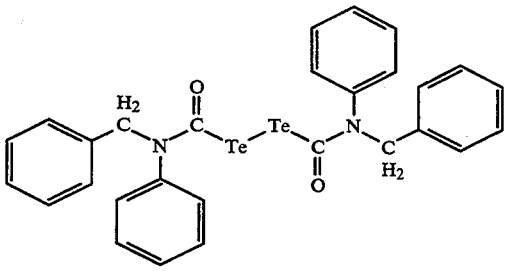

The synthesis examples of the tellurium compounds are shown below. The other tellurium compounds can also be synthesized in a similar manner.

SYNTHESIS EXAMPLE 1

Synthesis of tellurium compound (I-1)

In a well dried three neck flask was placed 100 ml of dry dimethylformamide (DMF). In the flask was further added 7.65 g of tellurium powder, and the mixture was stirred to form a suspension. The atmosphere in the reaction system was replaced with argon, and 2.64 g of sodium hydride (60% assay in oil) was immediately added to the suspension. It was stirred for 1 hour at room temperature, and was further stirred for 3 hours while gradually elevating the temperature at 90° to 100° C. The reaction mixture was cooled to room temperature, and was further cooled to −10° C. To the mixture was dropwise added 10.2 g of N-methyl-N-phenylcarbamoyl chloride dissolved in 50 ml of dry DMF. The reaction mixture was stirred for 5 hours at room temperature. The solvent was evaporated under reduced pressure. The obtained mixture of crystals and oil was filtered under reduced pressure to separate the oil from the crystals. The obtained oil was purified with a silica gel column chromatography (methylene chloride/ethyl acetate=20/1). Thus white crystals (4.2 g) were obtained. They were recrystalized with 100 ml of a solvent (methanol/n-hexane=1/9) to obtain 3.5 g of white crystals (29%). The melting point was 134° to 135.5° C. (dec.). The subject compound was confirmed by a nuclear magnetic resonance spectrum, a mass spectrum, an infrared absorption spectrum and an elementary analysis.

SYNTHESIS EXAMPLE 2

Synthesis of tellurium compound (I-25)

In a well dried three neck flask were placed 80 ml of dry DMF, 6.38 g of tellurium powder and 2.2 g of sodium hydride (60% assay in oil). The atmosphere in the reaction system was replaced with argon. The mixture was stirred for 3 hours at 90° to 100° C. in a stream of argon. The reaction mixture was cooled to 0° C. To the mixture was dropwise added 11.6 g of N,N-diphenylcarbamoyl chloride dissolved in 50 ml of dry DMF. The reaction mixture was stirred for 12 hours at room temperature, and DMF was evaporated under reduced pressure to reduce the volume of the reaction mixture to 70 ml. To the mixture was added 70 ml of methylene chloride, and a formed white precipitate was filtered out. The filtrate was condensed and dried to obtain a solid. To the solid was added 30 ml of methylene chloride, and a formed white precipitate was filtered out. The previously formed precipitate was added to the precipitate, and the mixture was dissolved in 200 ml of methylene chloride. Insoluble matters were filtered out, and methylene chloride was evaporated under reduced pressure to obtain 7.6 g of crude crystals. They were recrystalized with 300 ml of acetonitrile to obtain 5.2 g of white crystals (40%). The melting point was 194° to 195° C. (dec.). The subject compound was confirmed by a nuclear magnetic resonance spectrum, a mass spectrum, an infrared absorption spectrum and an elementary analysis.

SYNTHESIS EXAMPLE 3

Synthesis of tellurium compound (II-2)

In a well dried three neck flask was placed 100 ml of dry DMF. In the flask was further added 7.65 g of tellurium powder, and the mixture was stirred to form a suspension. The atmosphere in the reaction system was replaced with argon, and 2.64 g of sodium hydride (60% assay in oil) was immediately added to the suspension. It was stirred for 1 hour at room temperature, and was further stirred for 3 hours while gradually elevating the temperature at 90° to 100° C. The reaction mixture was cooled to room temperature, and was further cooled to −10° C. To the mixture was dropwise added 10.2 g of N-methyl-N-phenylcarbamoyl chloride dissolved in 50 ml of dry DMF. The reaction mixture was stirred for 5 hours at room temperature. The solvent was evaporated under reduced pressure. The obtained mixture of crystals and oil was filtered under reduced pressure to separate the crystals from the oil. The obtained crystals (610 mg) were washed with n-hexane, and recrystalized with 20 ml of acetonitrile to obtain 250 mg of reddish brown crystals (1.6%). The melting point was 207° to 208.5° C. (dec.). The subject compound was confirmed by a nuclear magnetic resonance spectrum, a mass spectrum, an infrared absorption spectrum and an elementary analysis.

SYNTHESIS EXAMPLE 4

Synthesis of tellurium compound (II-1)

In a well dried three neck flask were placed 80 ml of dry DMF, 6.38 g of tellurium powder and 2.2 g of sodium hydride (60% assay in oil). The atmosphere in the reaction system was replaced with argon. The mixture was stirred for 3 hours at 90° to 100° C. in a stream of argon. The reaction mixture was cooled to 0° C. To the mixture was dropwise added 11.6 g of N,N-diphenylcarbamoyl chloride dissolved in 50 ml of dry DMF. The reaction mixture was stirred for 12 hours at room temperature, and DMF was evaporated under reduced pressure to reduce the volume of the reaction mixture to 70 ml. To the mixture was added 70 ml of methylene chloride, and a formed white precipitate was filtered out. The filtrate was condensed and dried to obtain a solid. To the solid was added 30 ml of methylene chloride, and a formed white precipitate was filtered out. The filtrate was condensed and purified with a silica gel column chromatography (methylene chloride) to obtain 1.2 g of crystals. They were recrystalized with 110 ml of acetonitrile to obtain 1.0 g of reddish brown crystals (6.2%). The melting point was 184° to 185° C. (dec.). The subject compound was confirmed by a nuclear magnetic resonance spectrum, a mass spectrum, an infrared absorption spectrum and an elementary analysis.

Two or more the tellurium compounds represented by the formula (I) or (II) can be used in combination.

The amount of the tellurium compound of the invention depends on the nature of the silver halide grains and the conditions of the chemical sensitization. The amount is preferably in the range of $10^{-8}$ to $10^{-2}$ mol based on 1 mol of the silver halide, and more preferably in the range of $10^{-7}$ to $5\times10^{-3}$ mol.

The silver halide emulsion is sensitized with the tellurium compound at a pAg preferably in the range of 6 to 11, and more preferably in the range of 7 to 10. The silver halide emulsion is sensitized at a temperature preferably in the range of 40° C. to 95° C., and more preferably in the range of 50° C. to 85° C.

In the photographic material of the invention, the silver halide emulsion is preferably sensitized with a noble metal (such as gold, platinum, palladium, iridium) sensitizer in addition to the tellurium sensitizer. A gold sensitizer is particularly preferred. Examples of the gold sensitizer include chloroauric acid, potassium chloroaurate, potassium aurithiocyanate, gold sulfide and gold selenide. The noble metal sensitizer is preferably used in an amount of $10^{-7}$ to $10^{-2}$ mole based on 1 mole of the silver halide.

In the photographic material of the invention, the silver halide emulsion can be sensitized with a sulfur sensitizer in addition to the tellurium sensitizer. The sulfur sensitizer is an unstable sulfur compound such as a thiosulfate (e.g., hypo), a thiourea (e.g., diphenylthiourea, triethylthiourea, allylthiourea) and rhodanine. The sulfur sensitizer is preferably used in an amount of $10^{-7}$ to $10^{-2}$ mole based on 1 mole of the silver halide.

In the photographic material, the silver halide emulsion can also be sensitized with a selenium sensitizer in addition to the tellurium sensitizer. The selenium sensitizer is a labile selenium compound. Examples of the selenium sensitizers include colloidal selenium; selenoureas (e.g., selenourea, N,N-dimethylselenourea, tetramethylselenourea); selenoamides (e.g., selenoacetamide, N,N-dimethylselenobenzamide); selenoketones (e.g., selenoacetone, selenobenzophenone); selenides (e.g., triphenylphosphine selenide, diethyl selenide); selenophosphates (e.g., tri-p-trylselenophosphate); selenocarboxylic acids; selenoesters; and isoselenocyanates. The selenium sensitizers are described in Japanese Patent Publication No. 44(1969)-15748. The selenium sensitizer is preferably used in an amount of $10^{-8}$ to $10^{-3}$ mol based on 1 mol of the silver halide.

Further, the silver halide emulsion can also be sensitized with a reduction sensitizer in addition to the tellurium sensitizer. Examples of the reduction sensitizers include stannous chloride, aminoiminomethanesulfinic acid, a hydrazine derivative, borane (e.g., borane-dimethylamine complex), silane and a polyamine compound.

Two or more sensitizations can be used in combination of the tellurium sensitization of the present invention. A combination of tellurium with gold, sulfur and selenium is particularly preferred.

The silver halide emulsion is sensitized with the tellurium sensitizer preferably in the presence of a silver halide solvent. Examples of the silver halide solvents include thiocyanate salts (e.g., potassium thiocyanate), thioethers (e.g., 3,6-dithia-1,8-octanediol), tetra-substituted thiourea compounds (e.g., tetramethylthiourea), thion compounds, mercapto compounds, mesoionic compounds, selenoethers, telluroethers and sulfites. Ammonia, potassium rhodanide, ammonium rhodanide and amine compounds are also available as the silver halide solvent. The thiocyanate salt, the thioether, the tetra-substituted thiourea compound and the thion compound are preferred. The thiocyanate salt is particularly preferred The thioethers are described in U.S. Pat. Nos. 3,021,215, 3,271,157, 3,574,628, 3,704,130, 4,276,374 and 4,297,439, Japanese Patent Publication No. 58(1983)-30571, and Japanese Patent Provisional Publication No. 60(1985)-136736. The tetra-substituted thiourea compounds are described in U.S. Pat. No. 4,221,863 and Japanese Patent Publication No. 59(1984)-11892. The thion compounds are described in Japanese Patent Publication No. 60(1985)-29727, and Japanese Patent Provisional Publications No. 53(1978)-144319, No. 53(1978)-82408 and No. 55(1980)-77737. The mercapto compounds are described in Japanese Patent Publication No. 63(1988)-29727. The mesoionic compounds are described in Japanese Patent Provisional Publication No. 60(1985)-163042. The selenoethers are described in U.S. Pat. No. 4,782,013. The telluroethers are described in Japanese Patent Provisional Publication No. 2(1990)-118566. The amine compounds are described in Japanese Patent Provisional Publication No. 54(1979)-100717. The silver halide solvent is preferably used in an amount of $10^{-5}$ to $10^{-2}$ mole based on 1 mole of the silver halide.

The silver halide emulsion used in the present invention preferably is a silver bromide, silver iodobromide, silver iodochlorobromide, silver chlorobromide or silver chloride emulsion.

The shape of the silver halide grain in the photographic emulsion may be either in the form of a regular crystal such as cube and octahedron or in the form of an irregular crystal such as globular shape and tabular shape. The shape of the grain may be complex of these crystals. A mixture of these crystals is also available. The regular crystal is particularly preferred.

The silver halide grain may have either a homogeneous structure or a heterogeneous structure, in which halogen compositions inside and outside are different from each other. The silver halide grain may have a layered structure, in which iodide contents in the inside layer and the outside layer are different from each other. The iodide content in the inside layer usually is larger than in the outside layer. A latent image may be mainly formed either on surface of the grain (a negative emulsion) or inside the grain (an internal latent image emulsion or a fogged direct reversal emulsion). The latent image is preferably formed on surface of the grain.

The silver halide emulsion used in the invention preferably is a tabular grain emulsion in which tabular silver halide grains are contained in an amount of 50% or more based on the total projected area of all the grains. The tabular silver halide grains have a thickness of not more than 0.5 $\mu$m (preferably not more than 0.3 $\mu$m), a diameter of not more than 0.6 $\mu$m and a mean aspect ratio of not less than 3. Further, the silver halide emulsion used in the invention preferably is a monodispersed emulsion, which has such an almost uniform grain size distribution that a statistic coefficient of variation is not more than 20%. The coefficient of variation (S/d) is determined by dividing a standard deviation (S) by a diameter (d), which is determined by approximating the projected area of the grain to a circle. A mixture of the tabular grain emulsion and the monodispersed emulsion is also available.

The photographic emulsion used in the invention can be prepared by conventional processes, which are described in P. Glafkides, Chimie er Physique Photographeque (Paul Monter Co., 1967); G. F. Duffin, Photographic Emulsion Chemistry (Focal Press, 1966); and V. L. Zelikman et al, Making and Coating Photographic Emulsion (Focal Press, 1964).

The previously mentioned silver halide solvent can be used to control the grain growth in formation of the silver halide grains.

At the stage for formation of the silver halide grains or physical ripening thereof, a cadmium salt, a zinc salt, a thallium salt, an iridium salt (or its complex salt), a rhodium salt (or its complex salt) or an iron salt (or its complex salt) can be added to the emulsion.

A hydrophilic colloid is used as a binder or a protective colloid for the emulsion layer or an intermediate layer of the photographic material of the invention. Gelatin is an advantageous hydrophilic colloid. The other protective colloids are also available. Examples of the other protective colloids include proteins such as a gelatin derivative, a graft polymer of gelatin and another polymer, albumin and casein; saccharide derivatives such as a cellulose derivative (e.g., hydroxyethyl cellulose, carboxymethyl cellulose and cellulose sulfate), sodium alginate and a starch derivative; and synthetic hydrophilic homopolymers or copolymers such as polyvinyl acetal, a partial acetal of polyvinyl alcohol, poly-N-vinylpyrrolidone, polyacrylic acid, polymethacrylic acid, polyacrylamide, polyvinyl imidazole and polyvinyl pyrazole.

Examples of gelatin used for the layers include general-purpose lime-processed gelatin, acid-processed gelatin and enzyme-processed gelatin. The enzyme-processed gelatin is described in Bull. Soc. Phot. Japan, No. 16, pp. 30 (1980). A hydrolysis product of gelatin is also available.

The hydrophilic colloidal layer of the photographic material can contain an inorganic or organic hardening agent. Examples of the hardening agents include a chromium salt; an aldehyde (e.g., formaldehyde, glyoxal and glutaraldehyde); an N-methylol compound (e.g., dimethylol urea); an active halogen compound (e.g., 2,4-dichloro-6-hydroxy-1,3,5-triazine and sodium salt thereof); an active vinyl compound (e.g., 1,3-bisvinylsulfonyl-2-propanol, 1,2-bis(vinylsulfonylacetamide)ethane, bis(vinylsulfonylmethyl)ether and a vinyl polymer having vinylsulfonyl group on its side chain); an N-carbamoylpyridinium salt (e.g., (1-morpholinocarbonyl-3-pyridinio)methanesulfonate); and a haloamidinium salt (e.g., 1-(1-chloro-1-pyrizinomethylene)pyrrolizinium 2-naphthalenesulfonate). The active halogen compound, the active vinyl compound, the N-carbamoylpyridinium salt and the haloamidinium salt are preferred because they quickly harden the layers. The active halogen compound and the active vinyl compound are particularly preferred because they give a stable photographic property to the photographic material.

The silver halide photographic emulsion used in the invention can be spectrally sensitized by a sensitizing dye. Examples of the sensitizing dye include a methine dye, a cyanine dye, a merocyanine dye, a complex cyanine dye, a complex merocyanine dye, a holopolar cyanine dye, a hemicyanine dye, a styryl dye and a hemioxonol dye. The cyanine dye, the merocyanine dye and the complex merocyanine dye are particularly preferred. These dyes have a basic heterocyclic ring, which is generally contained in the cyanine dyes. Examples of the ring include a pyrroline ring, an oxazoline ring, a thiazoline ring, a pyrrole ring, an oxazole ring, a thiazole ring, a selenazole ring, an imidazole, ring, a tetrazole ring and a pyridine ring. Further, an alicyclic hydrocarbon ring or an aromatic hydrocarbon ring may be condensed with the above-described ring. Examples of the condensed ring include an indolenine ring, a benzindolenine ring, an indole ring, a benzoxazole ring, a naphthooxazole ring, a benzthiazole ring, a naphthothiazole ring, a benzserenazole ring, a benzimidazole ring and a quinoline ring. These rings may have a substituent group which is attached to the carbon atom of the rings.

The merocyanine dye or the complex merocyanine dye can contain a five-membered or six-membered heterocyclic ring having a ketomethylene structure. Examples of the heterocyclic rings include pyrazoline-5-one rings, thiohydantoin rings, 2-thiooxazolidine-2,4-dione rings, thizolidine-2,4-dione rings, rhodanine rings and thiobarbituric acid rings.

Two or more sensitizing dyes can be used in combination. A combination of the sensitizing dyes is often used for supersensitization. In addition to the sensitizing dyes, a supersensitizer can be contained in the photographic emulsion. The supersensitizer itself does not exhibit a spectral sensitization effect or does not substantially absorb visible light, but shows a supersensitizing activity. Examples of the supersensitizer include an aminostilbene compound substituted with a nitrogen-containing heterocyclic group, a condensate of an aromatic organic acid with formaldehyde, a cadmium salt, an azaindene compound and a combination thereof. A combination of the supersensitizers is particularly preferred. The aminostilbene compound is described in U.S. Pat. Nos. 2,933,390 and 3,635,721. The condensate of an aromatic organic acid and formaldehyde is described in U.S. Pat. No. 3,743,510. The combinations of the supersensitizers are described in U.S. Pat. Nos. 3,615,613, 3,615,641, 3,617,295 and 3,635,721.

The silver halide emulsion may contain an antifogging agent or a stabilizer. The antifogging agent prevents occurrence of a fog. The stabilizer has a function of stabilizing the photographic property. The antifogging agent and the stabilizer are used in preparation, storage or processing stage of the photographic material. Examples of the antifogging agents and stabilizers include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (e.g., 1-phenyl-5-mercaptotetrazole); mercaptopyrimidines; mercaptotriazines; thioketone compounds such as oxazolinethione; azaindenes such as triazaindenes, tetraazaindenes (e.g., 4-hydroxy-substituted (1,3,3a,7)tetraazaindenes) and pentaazaindenes; and amides such as benzenethiosulfonic amide, benzenesulfinic amide and benzenesulfonic amide.

The photographic material of the present invention may contain a surface active agent to improve various properties such as a coating property, an antistatic property, a slip property, an emulsifying or dispersing property, an antitacking property and photographic properties (e.g., development acceleration, high contrast and sensitization).

The hydrophilic colloidal layer of the photographic material may contain a water-soluble dye. The water-soluble dye has various functions such as a function of antiirradiation or a function of antihalation as well as a function as a filter dye. Examples of the dyes include an oxonol dye, a hemioxonol dye, a styryl dye, a merocyanine dye, an anthraquinone dye, an azo dye, a cyanine dye, an azomethine dye, a triarylmethane dye and a phthalocyanine dye. Further, an oil-soluble dye can be also added to the hydrophilic colloidal layer by emulsifying the dye in water by a known oil droplet dispersing method.

The photographic material of the invention can be used as a multi-layered multicolor photographic material provided with two or more light-sensitive layers which have different spectral sensitivities on a support.

The multi-layered color photographic material generally has at least one red-sensitive emulsion layer, at least one green-sensitive emulsion layer and at least one blue-sensitive emulsion layer on the support. The arrangement of those layers can be optionally determined. Preferably, the red-sensitive layer, the green sensitive layer and the blue sensitive layer are arranged from the support side in this order. The blue-sensitive layer, the green-sensitive layer and the red-sensitive layer may be arranged in this order from the support side. Further, the blue-sensitive layer, the red-sensitive layer and the green-sensitive layer may be arranged in this order from the support side. Further, two or more emulsion layers which are sensitive to the same color but show different sensitivities can be provided to enhance the sensitivity. Three emulsion layers can be provided to improve the graininess of the image. A non-light sensitive layer may be interposed between two or more emulsion layers having the same color sensitivity. Otherwise, between two or more emulsion layers having the same color sensitivity may be interposed another emulsion layer having a different color sensitivity. A light-reflecting layer such as a layer of silver halide grains can be provided under a high sensitive layer, particularly a high blue sensitive layer, to enhance the sensitivity.

The red sensitive emulsion layer generally contains a cyan coupler, the green sensitive emulsion layer generally contains magenta coupler, and the red sensitive emulsion layer generally contains a yellow color-forming coupler. However, other combinations are also available. For example, an infrared sensitive layer can be used to prepare a false color film or a film for exposure to a semiconductor laser beam.

Various color couplers can be used for the invention. Concrete examples of the couplers are described in the patents cited in Research Disclosure No. 17643, VII C-G.

As a yellow coupler, preferred are those described in, for example, U.S. Pat. Nos. 3,933,501, 4,022,620, 4,326,024, 4,401,752 and 4,248,961, Japanese Patent Publication No. 58(1983)-10739, and British Patents No. 1,425,020 and No. 1,476,760.

Preferred magenta couplers are 5-pyrazolone type and pyrazoloazole type compounds. Particularly preferred magenta couplers are those described in U.S. Pat. Nos. 4,310,619 and 4,351,897, European Patent No. 73,636, U.S. Pat. Nos. 3,061,432 and 3,725,067, Research Disclosure No. 24220 (June, 1984), Japanese Patent Provisional Publication No. 60(1985)-33552, Research Disclosure No. 24230 (June, 1984), Japanese Patent Provisional Publication No. 60(1985)-43659, U.S. Pat. Nos. 4,500,630 and 4,540,654.

As a cyan coupler, there can be mentioned phenol type and naphthol type couplers, and preferred examples are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Publication No. 3,329,729, European Patents No. 121,365A and No. 161,626A, and U.S. Pat. Nos. 3,446,622, 4,333,999, 4,775,616, 4,451,559, 4,427,767, 4,690,889, 4,254,212 and 4,296,199.

A colored coupler may be used to compensate incidental absorption of a formed dye. The colored coupler is described in Research Disclosure No. 17643, VII-G, U.S. Pat. No. 4,163,670, Japanese Patent Publication No. 57(1982)-39413, U.S. Pat. Nos. 4,004,929 and 4,138,258, and British Patent No. 1,146,368.

A coupler which gives a color developing dye exhibiting a proper diffusion is also available. The couplers are described in U.S. Pat. No. 4,366,237. British Patent No. 2,125,570, European Patent No. 96,570, and West German Patent Publication No. 3,234,533.

Typical examples of polymerized dye-forming couplers are described in U.S. Pat. Nos. 3,451,820, 4,080,211, 4,367,282, 4,409,320 and 4,576,910, and British Patent No. 2,102,173.

A coupler which releases a photographically useful residue according to a coupling reaction can be also used in the invention. A DIR coupler which releases a development inhibitor is available. The DIR coupler is described in Research Disclosure No. 17643, VII-F, Japanese Patent Provisional Publications No. 57(1982)-151944, No. 57(1982)-154234, No. 60(1985)-184248 and No. 63(1988)-37346, and U.S. Pat. No. 4,248,962.

A coupler which imagewise releases a nucleating agent or a development accelerator in a development process is also available. This coupler is described in British Patents No. 2,097,140 and No. 2,131,188, and Japanese Patent Provisional Publications No. 59(1984)-157638 and No. 59(1984)-170840.

Examples of other couplers available for the photographic material of the invention include a competing coupler, a polyvalent coupler, a DIR redox compound, a DIR coupler-releasing coupler, a coupler which releases a dye having restoration to original color after an elimination reaction, a bleach accelerator-releasing coupler and a coupler which releases ligand. The competing coupler is described in U.S. Pat. No. 4,130,427. The polyvalent coupler is described in U.S. Pat. Nos. 4,283,472, 4,338,393 and 4,310,618. The DIR redox compound-releasing couplers, the DIR coupler-releasing couplers, the DIR coupler-releasing redox compounds and the DIR redox-releasing redox compounds are described in Japanese Patent Provisional Publications No. 60(1985)-185950 and No. 62(1987)-24252. The coupler which releases a dye having restoration to original color after elimination is described in European Patent No. 173,302A. The bleach accelerator-releasing coupler is described in Research Disclosure No. 11449, ibid. No. 24241, and Japanese Patent Provisional Publication No. 61(1986)-201247. The coupler which releases ligand is described in U.S. Pat. No. 4,553,477.

The couplers used in the invention can be introduced into the photographic material by various known dispersing methods.

Examples of a high-boiling solvent used in an oil in water dispersing method are described in U.S. Pat. No. 2,322,027.

Examples of the high-boiling organic solvent having a boiling point of not lower than 175° C. under a normal pressure used in the oil in water dispersing method include phthalates (e.g., dibutyl phthalate, dicyclohexyl phthalate, di-2 -ethylhexyl phthalate, decyl phthalate, bis(2,4-di-t-amylphenyl)phthalate, bis(2,4-di-t-amylphenyl)isophthalate, bis(1,1-diethylpropyl)phthalate); esters of phosphoric acid or phosphonic acid (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate); benzoates (e.g., 2-ethylhexyl benzoate, dodecyl benzoate, 2-ethylehecyl-p-hydroxybenzoate); amides (e.g., N,N-diethyldodecanamide, N,N-diethyllaurylamide, N-tetradecylpyrrolidone); alcohols or phenols (e.g., isostearyl alcohol, 2,4-di-tert-amylphenol); aliphatic carboxylic esters (e.g., bis(2-ethylhexyl)sebacate, dioctyl azelate, glycerol tributyrate, isostearyl lactate, trioctyl citrate); aniline derivatives (e.g., N,N-dibutyl-2-butoxyl-5-tert-octylaniline); and hydrocarbons (e.g., paraffin, dodecylbenzene, diisopropylnaphthalene). An organic solvent having a boiling point of not lower than about 30° C. preferably in the range of 50° C. to about 160° C. can be used as an auxiliary solvent. Examples of the auxiliary solvent include ethyl acetate, butyl acetate, ethyl propionate, methyl ethyl ketone, cyclohexanone, 2-ethoxyethyl acetate and dimethylformamide.

A process of a latex dispersing method, effects thereof and concrete examples of latex for impregnation are described in U.S. Pat. No. 4,199,363, West German Patent Applications (OLS) No. 2,541,274 and No. 2,541,230.

There is no specific limitation on the support on which the above-mentioned silver halide emulsion layer is provided. As the support materials, there can be employed flexible materials which are generally used for known photographic materials, such as plastic films, papers and cloths; and rigid materials such as glass, ceramics and metals. Preferred examples of the flexible support materials include semi-synthetic or synthetic polymers such as cellulose nitrate, cellulose acetate, cellulose butyl acetate, polystyrene, polyvinyl chloride, polyethylene terephthalate and polycarbonate; baryta papers; and other papers coated or laminated with α-olefin polymers (e.g., polyethylene, polypropylene or ethylene-butene copolymer). The support may be colored with dyes or pigments. Further, the support may be made black for light-blocking. The surface of the support is generally subjected to undercoating treatment for enhancing the adhesion with the photographic emulsion layer. The surface of the support may be further subjected to other various treatments such as glow discharge, corona discharge, irradiation with ultraviolet rays and flame treatment before or after the undercoating treatment.

The photographic emulsion layer and the hydrophilic colloidal layer can be coated on the support by a known coating method such as dip coating, roller coating, flood coating and extrusion coating. If desired, two or more layers can be simultaneously coated by the coating methods as described in U.S. Pat. Nos. 2,681,294, 2,761,791, 3,526,528 and 3,508,947.

The photographic material of the invention can be used as a monochromatic or color photographic material. Concretely, it can be used as color negative films for domestic use or cinematographic use; and other films or papers for slide projection use or television use, such as color reversal films, color papers, color positive films and color reversal papers. Further, the photographic material of the invention can be also used as monochromatic light-sensitive materials for X-rays by using a mixture of three-color couplers described in "Research Disclosure" No. 17,123, (July, 1978), or using black color-forming coupler described in U.S. Pat. No. 4,126,461 and British Patent No. 2,102,136. Moreover, the photographic material of the invention can be also used as films for plate making (e.g., lithographic films and scanner films), X-ray films for medical use or industrial use, monochromatic negative films for picture-taking, monochromatic photographic papers, microfilms for COM use or domestic use, and other light-sensitive printing materials.

The photographic material of the present invention can be used in a color diffusion transfer process. The color diffusion transfer process can be classified into a peel apart type, an integrated type and a film unit type which does not require peeling. The integrated type is described Japanese Patent Publications No. 46(1971)-16356 and No. 48(1973)-33697, Japanese Patent Provisional Publication No. 50(1975)-13040, and British Patent No. 1,330,524. The film unit type is described in Japanese Patent Provisional Publication No. 57(1982)-19345.

An acidic polymer layer protected with a neutralization timing layer can be provided in the color diffusion transfer photographic material. These layers have a function of allowing a broad latitude of the processing temperature.

The photographic light-sensitive material of the invention is used by an exposure process, a development process and a fixing process. Use of the photographic light-sensitive material of the present invention is described below.

Various exposure means can be employed in the exposure process. As the light source, any optional light source releasing a radiation corresponding to the sensitivity wavelength of the photographic material can be employed. Examples of the light sources generally used include natural light (sun light), incandescent lamp, halogen lamp, mercury lamp, fluorescent lamp, flash light sources (e.g., electric flash and metal-burning flashbulb). Light sources which emit light in the ultraviolet to infrared region can be also used as the recording light sources. For example, there can be mentioned gases, dye solutions, semiconductor lasers, light emission diode, and plasma light source. Also employable are fluorescent surface given by the stimulated phosphor with electron rays (e.g., CRT) and an exposure means in which a microshutter array using liquid crystal (LCD) or lanthanum-doped lead zirconate titanate (PLZT) is combined with a linear or plane-like light source. The spectral distribution used in the exposure process can be appropriately adjusted by color filters.

A color developing solution used in the development process of the photographic material according to the invention preferably is an alkaline aqueous solution mainly containing an aromatic primary amine-color developing agent. Aminophenol compounds and p-phenylenediamine compounds are preferably used as the color developing agent. Examples of the p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidethylaniline and 3-methyl-4-amino-N-ethyl-N-β-methoxyethylaniline. Sulfates, chlorides and p-toluenesulfonates of those compounds are also available. Generally, salts of diamines are more preferably employed than free diamines, because they show higher stability than free diamines.

The color developing solution generally contains pH buffering agents (e.g., carbonates of alkali metals, borates thereof and phosphates thereof), development inhibitors (e.g., bromides, iodides, benzimidazoles, benzothiazoles and mercapto compounds) or anti-fogging agents. If necessary, the color developing solution may further contain other additives such as preservatives (e.g., hydroxylamine and sulfite), organic solvents (e.g., triethanol amine and diethylene glycol), development accelerators (e.g., benzyl alcohol, polyethylene glycol, quarternary ammonium salts and amines), nucleus-forming agents (e.g., color-forming couplers, completing couplers and sodiumboron hydrides), development-assisting agents (e.g., 1-phenyl-3-pyrazolidone), viscosity-increasing agents, chelating agents (e.g., aminopolycarboxylic acid, aminopolyphosphonic acid, alkylphosphonic acid and phosphonocarboxylic acid), and antioxidants described in West German Patent Application (OLS) No. 2,622,950.

In the development process of color reversal photographic materials, color development is generally made after monochromatic development. A monochromic developing solution used in the monochromatic development generally contains various monochromatic developing agents such as dihydroxybenzenes (e.g., hydroquinone), 3-pyrazolidones (e.g., 1-phenyl-3-pyrazolidone), and aminophenols (e.g., N-methyl-p-aminophenol). Those monochromatic developing agents can be employed singly or in combination.

The photographic emulsion layer is generally subjected to bleaching process after the color development process. The bleaching process may be done simultaneously with a fixing process or separately from the fixing process. For the rapid processing, a bleach-fix process can be made after the bleaching process. As the bleaching agents, there can be used polyvalent metal compounds such as iron (III), cobalt (III), chromium (IV) and copper (II), peracids, quinones, and nitroso compounds. Examples of the bleaching agents include ferricyanides; dichromates; organic complex salts of iron (III) or cobalt (III) such as complex salts of aminopolycarboxylic acids (e.g., ethylenediaminetetraacetic acid, diethylenetriaminepentaacetic acid, nitrilotriacetic acid and 1,3-diamino-2-propanoltetraacetic acid) and complex salts of citric acid, tartaric acid and malic acid; persulfates; manganates; and nitrosophenol. Among them, ethylenediaminetetraacetic acid iron (III) salt, diethylenetriaminepentaacetic acid iron (III) salt and persulfate are preferred from the viewpoints of rapid processing and prevention of environmental pollution. Also preferred is ethylenediaminetetraacetic acid iron (III) complex salt in each of an individual bleaching solution (bleaching bath) and in a bleach-fix bath.

A bleaching accelerator can be optionally used in the bleaching bath, the bleach-fix bath or the prior bath to those baths. Examples of the effective bleaching accelerators include compounds having mercapto group or disulfide group as described in U.S. Pat. No. 3,893,858, West German Patents No. 1,290,812 and No. 2,059,988, Japanese Patent Provisional Publications No. 53(1978)-32736, No. 53(1978)-57831, No. 53(1978)-37418, No. 53(1978)-65732, No. 53(1978)-72623, No. 53(1978)-95630, No. 53(1978)-95631, No. 53(1978)-104232, No. 53(1978)-124424, No. 53(1978)-141623 and No. 53(1978)-28426, and Research Disclosure No. 17129 (July, 1978); thiazolidine derivatives as described in Japanese Patent Provisional Publication No. 50(1975)-140129; thiourea derivatives as described in Japanese Patent Publication No. 45(1970)-8506, Japanese Patent Provisional Publications No. 52(1977)-20832 and No. 53(1978)-32735, and U.S. Pat. No. 3,706,561; iodides as described in West German Patent No. 1,127,715 and Japanese Patent Provisional Publication No. 58(1983)-16235; polyethylene oxides as described in West German Patents No. 966,410 and No. 2,748,430; polyamine compounds as described in Japanese Patent Publication No. 45(1970)-8836; and compounds as described in Japanese patent Provisional Publications No. 49(1974)-42434, No. 49(1974)-59644, No. 53(1978)-94927, No. 54(1979)-35727, No. 55(1980)-26506 and No. 58(1983)-163940. In addition to the above-mentioned compounds, iodine ion and bromine ion can be also employed as the bleaching accelerator. As the bleaching accelerator, preferred are compounds having mercapto group or disulfide group because these compounds show high acceleration effects, and particularly preferred are compounds described in U.S. Pat. No. 3,893,858, West German Patent No. 1,290,812 and Japanese Patent Provisional Publication No. 53(1978)-95630. Also preferred are compounds described in U.S. Pat. No. 4,552,834. The above-mentioned bleaching accelerators may be contained in the photographic material. Employment of the bleaching accelerators is particularly effective in the bleach-fix process of color photographic materials for picture-taking.

Examples of fixing agents include thiosulfates, thiocyanates, thioether compound, thioureas, and iodides. Of these, thiosulfates are generally used. As the preservatives for the bleach-fix bath or the fixing solution, sulfites, bisulfites and carbonylbisulfurous acid addition products are preferably employed.

After the bleach-fix process or the fixing process, the photographic material is generally subjected to washing with water and stabilization. In the washing stage or the stabilization stage, a variety of known compounds can be used for preventing precipitation and saving water. For example, there can be used hard water-softening agents for preventing the precipitation, such as inorganic phosphoric acids, aminopolycarboxylic acids, organic aminopolyphosphotic acids and organic phosphoric acids; germicides, mildewcides and metal salts (e.g., magnesium salts, aluminum salts and bismuth salts) for preventing various bacteria, alga and mildew; surface active agents for preventing drying strain or drying mark; and various hardeners for film-hardening. Otherwise, compounds described in L. E. West, Photographic Science And Engineering, Vol. 6, pp 344–359, (1955) can be also employed. Chelating agents and mildewcides are particularly preferred.

In the washing process, countercurrent washing using two or more baths is generally employed to save water. Instead of the washing process, multi-stage countercurrent stabilizing process can be used, and in this case, 2–9 countercurrent baths are required. Various compounds may be added to the stabilizing baths to stabilize resulting images in addition to the above-mentioned additives. Examples of the compounds include various buffering agents for adjusting pH value of the resulting films (for example, adjusting to pH of 3–9), and aldehydes (e.g., formalin). Examples of the buffering agents include borates, methaborates, sodium tetraborate decahydrates, phosphates, carbonates, potassium hydroxide, sodium hydroxide, ammonia water, monocarboxylic acids, dicarboxylic acids and polycarboxylic acids, in appropriate combination. Further, if desired, other additives such as chelating agents (e.g., inorganic phosphoric acids, aminopolycarboxylic acids, organic phosphoric acids, organic phosphonic acids, aminopolyphosphonic acids and phosphonocarboxylic acids), germicides (e.g., benzoisothiazolinone, irithiazolone, 4-thiazolinebenzimidazole, halogenated phenol, sulfanylamide and benzotriazole), surface active agents, brightening agents and hardeners can be also employed. Those additives can be used in combination of two or more same kinds or different kinds.

As the pH-adjusting agents employable after the washing and stabilization processes, there can be preferably mentioned various ammonium salts such as ammonium chloride, ammonium nitrate, ammonium sulfate, ammonium phosphate, ammonium sulfite and ammonium thiosulfate.

In the use of the color photographic material for picture-taking, washing and stabilization process of one stage generally made after fixing process can be replaced with the aforementioned stabilization process and the washing process (water-saving stage). In this case, formalin used in the stabilizing bath can be omitted when the used magenta coupler has two equivalent weights.

The time required for the washing and stabilizing process depends on the kind of the photographic material or the treating conditions, but generally is in the range of 20 seconds to 10 minutes, preferably in the range of 20 seconds to 5 minutes.

The silver halide color photographic material can contain a color developing agent for simple processing and rapid processing. For incorporation of the color developing agent, various precursors releasing the color developing agents can be preferably employed. Examples of the precursors employable for the purpose include indolenine compounds as described in U.S. Pat. No. 3,342,597; Shchiff's base type compounds as described in U.S. Pat. No. 3,342,599 and Research Disclosure, Nos. 14,850 and 15159; aldol compounds as described in Research Disclosure, No. 13,924; metal complex salts as described in U.S. Pat. No. 3,719,492; urethane compounds as described in Japanese Patent Provisional Publication No. 53(1978)-135628; and other salt type precursors as described in Japanese Patent Provisional Publications No. 56(1981)-6235, No. 56(1981)-16133, No. 56(1981)-59232, No. 56(1981)-67842, No. 56(1981)-83734, No. 56(1981)-83735, No. 56(1981)-83736, No. 56(1981)-89735, No. 56(1981)-81837, No. 56(1981)-54430, No. 56(1981)-106241, No. 54(1979)-107236, No. 57(1982)-97531 and No. 57(1082)-83565.

Into the silver halide color photographic material may be incorporated 1-phenyl-3-pyrazolidones to accelerate color development. Typical compounds used for the purpose are described for example in Japanese Patent Provisional Publications No. 56(1981)-64339, No. 57(1982)-144547, No. 57(1982)-211147, No. 58(1983)-50532, No. 58(1983)-50533, No. 58(1983)-50534, No. 58(1983)-50535, No. 58(1983)-50536 and No. 58(1083)-115438.

The various baths (solutions) used in the above-mentioned processes generally can have a temperature in the range of 10° to 50° C. The temperature generally is in the range of 33° to 38° C., but it can be made higher to accelerate the processing to shorten the processing time. Otherwise, it can be made lower to improve qualities of the resulting images or to enhance the stability of the baths. Further, cobalt intensification described in West German Patent No. 2,226,770 or hydrogen peroxide intensification described in U.S. Pat. No. 3,674,499 can be made to save the silver of the photographic material.

The above-mentioned various baths may be equipped with a heater, a temperature sensor, a liquid level sensor, a circulating pump, a filter, a floating lid or a squeegee, if desired.

In the continuous processing, a replenisher for each bath can be used to prevent the bath composition from varying, whereby a uniform finish can be obtained. The replenisher can be used in an amount of half of the standard amount or smaller amount than half of the standard amount to reduce the cost.

When the photographic material of the invention is used as a color paper, the above-mentioned bleach-fix process is generally made, and when the photographic material of the invention is used as a color photographic material for picture-taking, the same process is made according to the necessity.

The present invention is further described by the following examples.

EXAMPLE 1

To 1 l of an aqueous solution containing 0.05 g of potassium bromide and 30 g of gelatin while stirring at 75° C. were simultaneously added 75 ml of an aqueous solution (1M) of silver nitrate and an aqueous solution (1M) of potassium bromide over 4 minutes while silver potential was kept at 0 mV to saturation calomel electrode.

To the mixture were simultaneously added 675 ml of an aqueous solution (1M) of silver nitrate and an aqueous solution (1M) of potassium bromide over 36 minutes while silver potential was kept at −30 mV.

After the grain formation, the emulsion was desalted according to a conventional flocculation method and washed with water. Then gelatin and water were added to the emulsion. The pH and pAg were adjusted to 6.4 and 8.6 respectively.

Thus, a monodispersed octahedral silver bromide emulsion was prepared. The emulsion has mean grain size of 0.25 μm, The distribution coefficient of the grain size is 11%.

The obtained emulsion was divided into small parts. Each part was chemically sensitized with the sensitizers set forth in Table 1 at 60° C. for 60 minutes. The amounts shown in Table 1 are the optimum values by which the sensitivity is most increased. The experiments were repeated for the lot numbers set forth in Table 1 from the synthesis of the sensitizers.

To the emulsion were added gelatin, 4-hydroxy-6-methyl-1, 3,3a,7-tetrazaindene, potassium polystyrenesulfonate and sodium dodecylbenzenesulfonate to prepare coating solutions.

On a cellulose triacetate film was provided an undercoating layer to prepare a support. On the support were coated the above-prepared coating solution for the emulsion layer and a coating solution for a protective layer containing gelatin, polymethyl methacrylate particles and sodium salt of 2,4-dichloro-6-hydroxy-s-triazine simultaneously according to a pressing out method.

Each of the prepared samples was exposed to sensitometry light through an optical wedge for 10 seconds, and was developed with the following developing solution (MAA-1) at 20° C. for 10 minutes. After the development was stopped, the samples were fixed, washed with water and dried according to a conventional method. Then, the densities of the samples were measured. The results are set forth in Table 1.

In Table 1, the sensitivity is a relative reciprocal value of the exposure required to obtain an optical density of the fogging value plus 0.2. The relative value is defined in the manner that the value of the sample No. 1 is 100. The amount of the sensitizer means a mole amount based on 1 mole of silver halide.

TABLE 1

| Sample No. | Sensitizer No. | Sensitizer Amount | Lot No. | Fog | Sensitivity |
|---|---|---|---|---|---|
| 1 | (A) | $3.2 \times 10^{-5}$ | (1) | 0.02 | 100 |
| 2 | (A) | $3.2 \times 10^{-5}$ | (2) | 0.02 | 98 |
| 3 | (B) | $2.4 \times 10^{-4}$ | (1) | 0.08 | 79 |
| 4 | (B) | $2.4 \times 10^{-4}$ | (2) | 0.02 | 25 |
| 5 | (C) | $1.6 \times 10^{-5}$ | (1) | 0.06 | 63 |
| 6 | (C) | $1.6 \times 10^{-5}$ | (2) | 0.02 | 32 |
| 7 | (C) | $1.6 \times 10^{-5}$ | (3) | 0.08 | 18 |
| 8 | (D) | $2.4 \times 10^{-4}$ | (1) | 0.02 | 9 |
| 9 | (D) | $2.4 \times 10^{-4}$ | (2) | 0.02 | 9 |

TABLE 1-continued

| Sample No. | Sensitizer No. | Sensitizer Amount | Lot No. | Fog | Sensitivity |
|---|---|---|---|---|---|
| 10 | (E) | $1.2 \times 10^{-4}$ | (1) | 0.05 | 16 |
| 11 | (E) | $1.2 \times 10^{-4}$ | (2) | 0.05 | 21 |
| 12 | None | — | — | 0.02 | 9 |
| 13 | (I-1) | $1.6 \times 10^{-5}$ | (1) | 0.02 | 184 |
| 14 | (I-1) | $1.6 \times 10^{-5}$ | (2) | 0.02 | 186 |
| 15 | (I-2) | $2.3 \times 10^{-5}$ | (1) | 0.03 | 155 |
| 16 | (I-2) | $2.3 \times 10^{-5}$ | (2) | 0.03 | 155 |
| 17 | (I-3) | $1.6 \times 10^{-5}$ | (1) | 0.02 | 172 |
| 18 | (I-3) | $1.6 \times 10^{-5}$ | (2) | 0.02 | 172 |
| 19 | (II-2) | $3.2 \times 10^{-5}$ | (1) | 0.02 | 182 |
| 20 | (II-2) | $3.2 \times 10^{-5}$ | (2) | 0.02 | 180 |
| 21 | (II-4) | $3.2 \times 10^{-5}$ | (1) | 0.02 | 172 |
| 22 | (II-4) | $3.2 \times 10^{-5}$ | (2) | 0.02 | 170 |
| 23 | (I-9) | $1.2 \times 10^{-5}$ | (1) | 0.02 | 162 |
| 24 | (I-9) | $1.2 \times 10^{-5}$ | (2) | 0.02 | 160 |
| 25 | (I-11) | $1.2 \times 10^{-5}$ | (1) | 0.02 | 165 |
| 26 | (I-11) | $1.2 \times 10^{-5}$ | (2) | 0.02 | 165 |
| 27 | (II-5) | $2.3 \times 10^{-5}$ | (1) | 0.02 | 178 |
| 28 | (II-5) | $2.3 \times 10^{-5}$ | (2) | 0.02 | 178 |

Comparative sensitizer (A)

Sodium thiosulfate

Comparative sensitizer (B)

Colloidal tellurium (disclosed in Canadian Patent No. 800,958 and synthesized according to Example 2 of the patent)

Comparative sensitizer (C)

Potassium telluride (disclosed in Canadian Patent No. 800,958 and British Patent No. 1,295,462)

Comparative sensitizer (D)

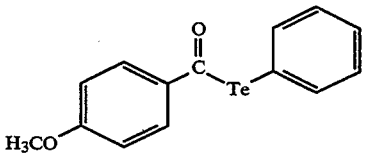

(disclosed in Japanese Patent Provisional Publication No. 53(1978)-57817

Comparative sensitizer (E)

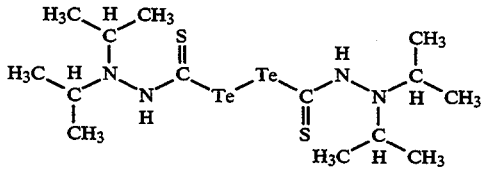

(disclosed in Japanese Patent Provisional Publication No. 53(1978)-57817

| Developing solution (MAA-1) | |
|---|---|
| Methol | 2.5 g |
| Ascorbic acid | 10 g |
| $Na_2B_4O_7.5H_2O$ | 35 g |
| Potassium bromide | 1 g |
| Water | to make up to 1 l |

As is evident from the results set forth in Table 1, the known tellurium sensitizers such as colloidal tellurium or potassium telluride show a high sensitivity, but a poor reproducibility and a high fogging value. Further, the sensitizing functions of the tellurium compounds disclosed in Japanese Patent Provisional Publication No. 53(1978)-57817 are poor, compared with the compounds of the present invention.

The tellurium compounds of the present invention show an excellent reproducibility. Further, the sensitizing functions of the compounds are superior to those of the conventional sulfur sensitizers.

EXAMPLE 2

To 1 l of an aqueous solution (pH 3.0) containing 0.35 g of potassium bromide and 40 g of gelatin while stirring at 75° C. were simultaneously added an aqueous solution containing 18 g of silver nitrate and an aqueous solution containing 12.7 g of potassium bromide over 20 minutes. To the mixture were simultaneously added an aqueous solution containing 156 g of silver nitrate and an aqueous solution containing 6.1 g/l of potassium iodide and 196 g/l of potassium bromide over 20 minutes according to an accelerating rate method wherein the last rate is 5.4 times as the first rate while silver potential was kept at +25 mV to saturation calomel electrode.

After the grain formation, the emulsion was desalted according to a conventional flocculation method and washed with water. Then gelatin and water were added to the emulsion. The pH and pAg were adjusted to 6.2 and 8.5 respectively. Thus, a monodispersed tetradecahedral silver iodobromide emulsion was prepared. The silver iodide content is about 2 mol %. The emulsion has mean grain size of 0.45 μm. The distribution coefficient of the grain size is 9%.

The obtained emulsion was divided into small parts. Each part was chemically sensitized with chloroauric acid ($1.2\times10^{-5}$ mole based on 1 mole of silver), potassium thiocyanate ($2\times10^{-3}$ mole based on 1 mole of silver) and the sensitizers set forth in Table 2 at 60° C.

The samples were further divided into two parts. To one of the two parts was added sodium salt of anhydro-5-chloro-5'-phenyl-9-ethyl-3,3'-(3-sulfopropyl)oxacarbocyanine hydroxide ($5.3\times10^{-4}$ mole based on 1 mole of silver) as a sensitizing dye.

To each of the samples were further added 3-{3-[2-(2,4-di-tert-amylphenoxy)butylylamino]benzoylamino}-1-2,4,6-trichlorophenyl)pyrazoline-5-one (magenta coupler), tricresyl phosphate (oil), 4-hydroxy-6-methyl-1,3,3a, 7-tetrazaindene (stabilizer), monosodium salt of 1-(m-sulfophenyl)-5-mercaptotetrazole (antifogging agent), sodium dodecylbenzenesulfonate (coating aid), 1,2-bis(vinylsulfonylacetylamino)ethane (hardening agent) and phenoxyethanol (antiseptic) to prepare a coating solution.

On a cellulose triacetate film was provided an undercoating layer to prepare a support. On the support were coated the above-prepared coating solution for the emulsion layer and a coating solution for a protective gelatin layer simultaneously according to a pressing out method.

Each of the prepared samples was exposed to light through an optical wedge and an interference filter of 419 nm (inherent sensitivity) or a yellow filter (SC-50 filter, spectral sensitivity) for 1/100 second. The samples were subjected to the following processes.

| Process | Time | Temperature |
|---|---|---|
| Color development | 2 minutes and 45 seconds | 38° C. |
| Bleaching | 3 minutes | 38° C. |
| Washing | 30 seconds | 24° C. |
| Fixing | 3 minutes | 38° C. |
| Washing (1) | 30 seconds | 24° C. |
| Washing (2) | 30 seconds | 24° C. |
| Stabilizing | 30 seconds | 38° C. |
| Drying | 4 minutes and 20 seconds | 55° C. |

The compositions of the processing solution are set forth below.

| | |
|---|---|
| Color developing solution | |
| Diethylenetriamine pentaacetate | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Sulfate salt of hydroxylamine | 2.4 g |
| Sulfate salt of 4-(N-ethyl-N-β-hydroxyethylamino)-2-methylaniline | 4.5 g |
| Water | to make up to 1.0 l |
| pH | 10.05 |
| Bleaching solution | |
| Sodium Fe(III) ethylenediaminetetraacetatetrihydrate | 100.0 g |
| Disodium ethylenediaminetetraacetate | 10.0 g |
| 3-Mercapto-1,2,4-triazole | 0.08 g |
| Ammonium bromide | 140.0 g |
| Ammonium nitrate | 30.0 g |
| Ammonia water (27%) | 6.5 ml |
| Water | to make up to 1.0 l |
| pH | 6.0 |
| Fixing solution | |
| Disodium ethylenediaminetetraacetate | 0.5 g |
| Ammonium sulfite | 20.0 g |
| Ammonium thiosulfate solution (700 g/l) | 290.0 ml |
| Water | to make up to 1.0 l |
| pH | 6.7 |
| Stabilizing solution | |
| Sodium p-toluenesulfinate | 0.03 g |
| Polyoxyethylene-p-monononylphenylether (average polymerization degree: 10) | 0.2 g |
| Disodium ethylenediaminetetraacetate | 0.05 g |
| 1,2,4-Triazole | 1.3 g |
| 1,4-Bis(1,2,4-triazole-1-ylmethyl)-piperazine | 0.75 g |
| Water | to make up to 1.0 l |
| pH | 8.5 |

The photographic sensitivities of the samples were measured. The results are set forth in Table 2. In Table 2, the sensitivities are relative reciprocal values of the exposure required to obtain an optical density of the fogging value plus 0.2. The inherent sensitivity is defined in the manner that the value of the sample No. 50 is 100. The spectral sensitivity is defined in the manner that the value of the sample No. 51 is 100. The amount of the sensitizer means a mole amount based on 1 mole of silver halide.

TABLE 2

| Sample No. | Sensitizer No. | Sensitizer Amount | Sensitizing dye | Fog | Sensitivities Inherent | Sensitivities Spectral |
|---|---|---|---|---|---|---|
| 50 | (A) | $2.4 \times 10^{-5}$ | ○ | 0.08 | 100 | — |
| 51 | (A) | $2.4 \times 10^{-5}$ | ● | 0.08 | 71 | 100 |
| 52 | (F) | $1.7 \times 10^{-5}$ | ○ | 0.38 | 145 | — |
| 53 | (F) | $1.7 \times 10^{-5}$ | ● | 0.38 | 105 | 149 |
| 54 | (I-1) | $1.2 \times 10^{-5}$ | ○ | 0.12 | 134 | — |
| 55 | (I-1) | $1.2 \times 10^{-5}$ | ● | 0.12 | 120 | 172 |

TABLE 2-continued

| Sample No. | Sensitizer No. | Sensitizer Amount | Sensitizing dye | Fog | Sensitivities Inherent | Sensitivities Spectral |
|---|---|---|---|---|---|---|
| 56 | (I-4) | $1.7 \times 10^{-5}$ | ○ | 0.12 | 130 | — |
| 57 | (I-4) | $1.7 \times 10^{-5}$ | ● | 0.12 | 117 | 161 |
| 58 | (II-2) | $1.7 \times 10^{-5}$ | ○ | 0.10 | 141 | — |
| 59 | (II-2) | $1.7 \times 10^{-5}$ | ● | 0.10 | 128 | 188 |

Remark: The sensitizing dye is used (●)or not used (○).

Comparative sensitizer (A)

Sodium thiosulfate

Comparative sensitizer (F)

N,N-dimethylselenourea

As is evident from the results set forth in Table 2, the samples of the present invention using the tellurium compound with a gold sensitizer show a high sensitivity. Further, the occurrence of the fog is decreased. Furthermore, the samples of the invention show a high spectral sensitivity.

EXAMPLE 3

A monodispersed tabular silver bromide emulsion was prepared (cf., Example 6 of Japanese Patent Provisional Publication No. 2(1990)-838). The emulsion has mean grain size of 1.05 μm. The average thickness of the grains is 0.19 μm. The average aspect ratio is 5.8. The distribution coefficient of the grain size is 10.5%.

After the grain formation, the emulsion was desalted according to a conventional flocculation method and washed with water. Then gelatin was added to the emulsion. The pH and pAg were adjusted to 6.2 and 8.3 respectively.

The obtained emulsion was divided into small parts. Each part was heated at 62° C. To each part were added sodium salt of anhydro-5,5'-dichloro-9-ethyl-3,3'-di(3-sulfopropyl)oxacarbocyanine hydroxide (520 mg based on 1 mole of silver) as a sensitizing dye and potassium iodide (50 mg based on 1 mole of silver). Each of the sensitizers set forth in Table 3 was added to each part. To each part were further added chloroauric acid ($1.2\times10^{-5}$ mole based on 1 mole of silver) and potassium thiocyanate ($6\times10^{-4}$ mole based on 1 mole of silver). Each part was sensitized at 62° C. for 30 minutes.

To each sample were further added 4-hydroxy-6-methyl-1,3,3a,7-tetrazaindene, phenoxyethanol, sodium dodecylbenzenesulfonate, 1-(m-sulfophenyl)-5-mercaptotetrazole, 2,4-bis(ethylamino)-6-hydroxyamino-s-triazine, hydroquinone and 2-bis(vinylsulfonylacetamido)ethane in the order to prepare a coating solution.

On a polyethylene terephthalate support were coated the above-prepared coating solution for the emulsion layer and a coating solution for a surface protective layer simultaneously according to a pressing out method.

Each of the prepared samples was exposed to light through an optical wedge and a yellow filter using a sensitometer for 1/100 second. The samples were developed with a developing solution for an automatic processing machine (RD-III produced by Fuji Photo Film Co., Ltd.) at 30° C. for 10 or 30 seconds. The samples were fixed, washed with water and dried according to a conventional method. Then, the photographic sensitivities of the samples were measured. The results are set forth in Table 3.

In Table 3, the sensitivity is a relative reciprocal value of the exposure required to obtain an optical density of the fogging value plus 1.0. The relative value is defined in the manner that the value of the sample No. 70 (30 seconds development) is 100. The amount of the sensitizer means a mole amount based on 1 mole of silver halide.

TABLE 3

| Sample | Sensitizers (amount) | | | Sensitivity | | Fog |
|---|---|---|---|---|---|---|
| No | (A) | (G) | (II-2) | 10 sec. | 30 sec. | 30 sec. |
| 70 | $2.4 \times 10^{-5}$ | — | — | 69 | 100 | 0.14 |
| 71 | $1.6 \times 10^{-5}$ | $8.0 \times 10^{-6}$ | — | 86 | 120 | 0.18 |
| 72 | — | — | $2.4 \times 10^{-5}$ | 104 | 112 | 0.18 |
| 73 | — | $8.0 \times 10^{-6}$ | $1.6 \times 10^{-6}$ | 116 | 138 | 0.27 |
| 74 | $8.0 \times 10^{-6}$ | $8.0 \times 10^{-6}$ | $1.2 \times 10^{-5}$ | 104 | 122 | 0.16 |

Comparative sensitizer (A)

Sodium thiosulfate

Comparative sensitizer (G)

Triphenylphosphine selenide

As is evident from the results set forth in Table 3, the samples (No. 72, No. 73 and No. 74) of the present invention using the tellurium sensitizer show a high sensitivity. Further, the occurrence of the fog is decreased. Furthermore, the samples of the invention show a high developing speed.

EXAMPLE 4

To 8 l of an aqueous solution containing 72 g of gelatin and 16 g of sodium chloride were simultaneously added an aqueous solution containing 1 kg of silver nitrate and an aqueous solution containing 161 g of potassium bromide and 265 g of sodium chloride at 52° C. over 32 minutes. Over the first 10 minutes, to the mixture were further added rhodium chloride ($5 \times 10^{-7}$ mole based on 1 mole of silver) and $K_3IrCl_6$ ($5 \times 10^{-7}$ mole based on 1 mole of silver). Thus, a silver chlorobromide emulsion was prepared. The silver bromide content is 23 mol %. The emulsion has mean grain size of about 0.3 μm.

The emulsion was desalted according to a conventional flocculation method and washed with water. Then gelatin and water were added to the emulsion. The pH and pAg were adjusted to 6.0 and 7.5 respectively.

The obtained emulsion was divided into small parts. Each part was chemically sensitized with the sensitizers set forth in Table 2 at 60° C. The conditions of the sensitization were so adjusted that the samples show the same sensitivity when it is exposed for 10 seconds.

To each of the samples were added gelatin, 4-hydroxy-6-methyl-1,3,3a,7-tetrazaindene, phenoxyethanol, hydroquinone, polyethyl acrylate latex and 2-bis(-vinylsulfonylacetylamino)ethane to prepare a coating solution.

On a polyethylene terephthalate support were simultaneously coated the above-prepared coating solution for the emulsion layer and a coating solution for a protective layer containing gelatin, polymethyl methacrylate, colloidal silica, polyethyl acrylate latex and sodium dodecylbenzenesulfonate according to a pressing out method.

Each of the prepared samples was exposed to light through an optical wedge for 10 seconds or $10^{-5}$ second. The samples were developed with a developing solution (LD-835 produced by Fuji Photo Film Co., Ltd.) at 38° C. for 20 seconds. The samples were then fixed with a fixing solution (LF-308 produced by Fuji Photo Film Co., Ltd.) at 36° C. for 20 seconds. They were washed with water and dried according to a conventional method. Then, the photographic sensitivities of the samples were measured. The results are set forth in Table 4.

In Table 4, the sensitivity is a relative reciprocal value of the exposure required to obtain an optical density of the fogging value plus 2.0. The relative value is defined in the manner that the values of the sample No. 80 (both 10 seconds and $10^{-5}$ second exposures) are 100. The amount of the sensitizer means a mole amount based on 1 mole of silver halide.

TABLE 4

| Sample | Sensitizer | | Sensitivity | |
|---|---|---|---|---|
| No. | No. | Amount | 10 sec. | $10^{-5}$ sec. |
| 80 | (A) | $2.4 \times 10^{-5}$ | 100 | 100 |
| 81 | (F) | $1.6 \times 10^{-5}$ | 100 | 126 |
| 82 | (I-1) | $1.8 \times 10^{-5}$ | 100 | 145 |
| 83 | (II-2) | $2.1 \times 10^{-5}$ | 100 | 151 |

Comparative sensitizer (A)

Sodium thiosulfate

Comparative sensitizer (F)

N,N-dimethylselenourea

As is evident from the results set forth in Table 4, the samples of the present invention show a high sensitivity even if the exposure time is short ($10^{-5}$ second). Accordingly, a high intensity reciprocity law failure is reduced in the samples of the invention. The experiments were repeated by using a silver chloride emulsion. As a result, analogous effects were observed.

EXAMPLE 5

Ammonia was added to an aqueous solution containing 7 g of potassium bromide and 36 g of gelatin. To the mixture were simultaneously added an aqueous solution containing 30 g of silver nitrate and an aqueous solution containing 19 g of potassium bromide and 3.8 g of potassium iodide to prepare an octahedral silver iodobromide core emulsion. The core emulsion has mean grain size of 0.28 μm.

The core emulsion was neutralized with acetic acid. To the emulsion were simultaneously added an aqueous solution containing 90 g of silver nitrate and an aqueous solution containing 0.4 mg of $K_3IrCl_6$, 63 g of potassium bromide and 0.9 g of potassium iodide to form a shell around the core. In preparation of grains, the emulsion was sensitized with reducing sensitizers (thiourea dioxide and thiosulfonic acid).

Thus a monodispersed octahedral double structured silver iodobromide emulsion (A) was obtained. The ratio of core to shell is 1:3 (silver content). The emulsion (A) has mean grain size of 0.45 μm. The distribution variation (S/d) is about 27%. The total AgI content is 4.0%. The AgI content in the core is 13%, and that in the shell is 1%.

The emulsion (A) was cooled to 35° C., desalted according to a conventional flocculation method and washed with water. Then gelatin and water were added to the emulsion. The pH and pAg were adjusted to 6.2 and 8.6 respectively.

The emulsion (A) was divided into two parts. Each part was chemically sensitized with the sensitizers set forth in Table 6, a sensitizing dye (described below), chloroauric acid ($1.8\times10^{-5}$ mole based on 1 mole of silver) and potassium thiocyanate ($2\times10^{-3}$ mole based on 1 mole of silver) at 50° C.

TABLE 5

| Emulsion No. | AgI cont. (%) | Grain size (μm) | S/d (%) | Aspect ratio | Grain structure core←→shell (AgI content) | Grain shape (*) |
|---|---|---|---|---|---|---|
| (A) | 4.0 | 0.45 | 27 | 1 | 25% (13%) 75% (1%) | II-8 |
| (B) | 8.9 | 0.70 | 14 | 1 | 30% (25%) 70% (2%) | II-8 |
| (C) | 2.0 | 0.55 | 25 | 7 | 100% (2%) | I-T |
| (D) | 9.0 | 0.65 | 25 | 6 | 12% (0%) 59% (11%) 29% (8%) | III-T |
| (E) | 9.0 | 0.85 | 23 | 5 | 8% (0%) 59% (11%) 33% (8%) | III-T |
| (F) | 14.5 | 1.25 | 25 | 3 | 37% (34%) 63% (3%) | II-sT |
| (G) | 1.0 | 0.07 | 15 | 1 | 100% (1%) | I-F |

Remark*:
II-8 (double layered octahedral grain)
I-T (single layered tabular grain)
III-T (triple layered tabular grain)
II-sT (doublelayered semitabular grain)
I-F (single layered fine grain)

Silver halide emulsions (B) to (G) set forth in Table 5 were further prepared in the following manner.

(1) The emulsions (A) to (F) set forth in Table 5 were subjected to reduction sensitization using thiourea dioxide and a thiosulfonic acid in the grain formation stage in accordance with the example described in Japanese Patent Provisional Publication No. 2(1990)-191938.

(2) The emulsions (A) to (F) set forth in Table 5 were subjected to gold sensitization, sulfur sensitization and selenium sensitization in the presence of spectral sensitizing dyes of each sensitive layers and sodium thiocyanate in accordance with the example described in Japanese Patent Provisional Publication No. 3(1991)-237450.

(3) In preparation of the tabular grains set forth in Table 5, gelatin of a low molecular weight was used in accordance with the example described in Japanese Patent Provisional Publication No. 1(1989)-158426.

(4) In the tabular grains and normal crystal grains having grain structure of the emulsions set forth in Table 5, such a dislocation line as described in Japanese Patent Provisional Publication No. 3(1991)-237450 was observed by a high pressure electron microscope.

On a cellulose triacetate film was provided an undercoating layer to prepare a support. On the support were coated the following layers containing the above-prepared emulsions to prepare a multi-layered color photographic material.

Composition of Layers

The coating amounts (g/m²) are shown below. The value for silver halide means a coating amount of silver (Ag). The amount of a sensitizing dye is a mole amount based on 1 mole of silver halide contained in the same layer.

| | | |
|---|---|---|
| The first layer (Antihalation layer) | | |
| Black colloidal silver | (Ag) | 0.18 |
| Gelatin | | 1.40 |
| Magenta coupler (ExM-1) | | 0.18 |
| Additive (ExF-1) | | $2.0\times10^{-3}$ |
| High boiling point organic solvent (HBS-1) | | 0.20 |
| The second layer (Intermediate layer) | | |
| Silver halide emulsion (G) | (Ag) | 0.065 |
| 2,5-Di-tert-pentadecylhydroquinone | | 0.18 |
| Cyan coupler (ExC-2) | | 0.020 |
| Ultraviolet absorbent (UV-1) | | 0.060 |
| Ultraviolet absorbent (UV-2) | | 0.080 |
| Ultraviolet absorbent (UV-3) | | 0.10 |
| High boiling point organic solvent (HBS-1) | | 0.10 |
| High boiling point organic solvent (HBS-2) | | 0.020 |
| Gelatin | | 1.04 |
| The third layer (Low red sensitive layer) | | |
| Silver halide emulsion (A) | (Ag) | 0.25 |
| Silver halide emulsion (B) | (Ag) | 0.25 |
| Sensitizing dye (ExS-1) | | $6.9\times10^{-5}$ |
| Sensitizing dye (ExS-2) | | $1.8\times10^{-5}$ |
| Sensitizing dye (ExS-3) | | $3.1\times10^{-4}$ |
| Cyan coupler (ExC-1) | | 0.17 |
| Cyan coupler (ExC-3) | | 0.030 |
| Cyan coupler (ExC-4) | | 0.10 |
| Cyan coupler (ExC-5) | | 0.020 |
| Cyan coupler (ExC-7) | | 0.0050 |
| Cyan coupler (ExC-8) | | 0.010 |
| Additive (Cpd-2) | | 0.025 |
| High boiling point organic solvent (HBS-1) | | 0.10 |
| Gelatin | | 0.87 |
| The fourth layer (Middle red sensitive layer) | | |
| Silver halide emulsion (D) | (Ag) | 0.70 |
| Sensitizing dye (ExS-1) | | $3.5\times10^{-4}$ |
| Sensitizing dye (ExS-2) | | $1.6\times10^{-5}$ |
| Sensitizing dye (ExS-3) | | $5.1\times10^{-4}$ |
| Cyan coupler (ExC-1) | | 0.13 |
| Cyan coupler (ExC-2) | | 0.060 |
| Cyan coupler (ExC-3) | | 0.0070 |
| Cyan coupler (ExC-4) | | 0.090 |
| Cyan coupler (ExC-5) | | 0.025 |
| Cyan coupler (ExC-7) | | 0.0010 |
| Cyan coupler (ExC-8) | | 0.0070 |
| Additive (Cpd-2) | | 0.023 |
| High boiling point organic solvent (HBS-1) | | 0.10 |
| Gelatin | | 0.75 |
| The fifth layer (High red sensitive layer) | | |
| Silver halide emulsion (E) | (Ag) | 1.40 |
| Sensitizing dye (ExS-1) | | $2.4\times10^{-4}$ |
| Sensitizing dye (ExS-2) | | $1.0\times10^{-4}$ |
| Sensitizing dye (ExS-3) | | $3.4\times10^{-4}$ |
| Cyan coupler (ExC-1) | | 0.12 |
| Cyan coupler (ExC-3) | | 0.045 |
| Cyan coupler (ExC-6) | | 0.020 |
| Cyan coupler (ExC-8) | | 0.025 |
| Additive (Cpd-2) | | 0.050 |
| High boiling point organic solvent (HBS-1) | | 0.22 |
| High boiling point organic solvent (HBS-2) | | 0.10 |
| Gelatin | | 1.20 |
| The sixth layer (Intermediate layer) | | |
| Additive (Cpd-1) | | 0.10 |
| High boiling point organic solvent (HBS-1) | | 0.50 |
| Gelatin | | 1.10 |
| The seventh layer (Low green sensitive layer) | | |
| Silver halide emulsion (C) | (Ag) | 0.35 |
| Sensitizing dye (ExS-4) | | $3.0\times10^{-5}$ |
| Sensitizing dye (ExS-5) | | $2.1\times10^{-4}$ |
| Sensitizing dye (ExS-6) | | $8.0\times10^{-4}$ |
| Magenta coupler (ExM-1) | | 0.010 |
| Magenta coupler (ExM-2) | | 0.33 |
| Magenta coupler (ExM-3) | | 0.086 |
| Yellow coupler (ExY-1) | | 0.015 |
| High boiling point organic solvent (HBS-1) | | 0.30 |
| High boiling point organic solvent (HBS-3) | | 0.010 |
| Gelatin | | 0.73 |
| The eighth layer (Middle green sensitive layer) | | |
| Silver halide emulsion (D) | (Ag) | 0.80 |
| Sensitizing dye (ExS-4) | | $3.2\times10^{-5}$ |
| Sensitizing dye (ExS-5) | | $2.2\times10^{-4}$ |
| Sensitizing dye (ExS-6) | | $8.4\times10^{-4}$ |
| Magenta coupler (ExM-2) | | 0.13 |
| Magenta coupler (ExM-3) | | 0.030 |

-continued

| | | |
|---|---|---|
| Yellow coupler (ExY-1) | | 0.018 |
| High boiling point organic solvent (HBS-1) | | 0.16 |
| High boiling point organic solvent (HBS-3) | | $8.0 \times 10^{-3}$ |
| Gelatin | | 0.90 |
| The ninth layer (High green sensitive layer) | | |
| Silver halide emulsion (E) | (Ag) | 1.25 |
| Sensitizing dye (ExS-4) | | $3.7 \times 10^{-5}$ |
| Sensitizing dye (ExS-5) | | $8.1 \times 10^{-5}$ |
| Sensitizing dye (ExS-6) | | $3.2 \times 10^{-4}$ |
| Cyan coupler (ExC-1) | | 0.010 |
| Magenta coupler (ExM-1) | | 0.030 |
| Magenta coupler (ExM-4) | | 0.040 |
| Magenta coupler (ExM-5) | | 0.019 |
| Additive (Cpd-3) | | 0.040 |
| High boiling point organic solvent (HBS-1) | | 0.25 |
| High boiling point organic solvent (HBS-2) | | 0.10 |
| Gelatin | | 1.44 |
| The tenth layer (Yellow filter layer) | | |
| Yellow colloidal silver | (Ag) | 0.030 |
| Additive (Cpd-1) | | 0.16 |
| High boiling point organic solvent (HBS-1) | | 0.60 |
| Gelatin | | 0.60 |
| The eleventh layer (Low blue sensitive layer) | | |
| Silver halide emulsion (C) | (Ag) | 0.18 |
| Sensitizing dye (ExS-7) | | $8.6 \times 10^{-4}$ |
| Yellow coupler (ExY-1) | | 0.020 |
| Yellow coupler (ExY-2) | | 0.022 |
| Yellow coupler (ExY-3) | | 0.050 |
| Yellow coupler (ExY-4) | | 0.020 |
| High boiling point organic solvent (HBS-1) | | 0.28 |
| Gelatin | | 1.10 |
| The twelfth layer (Middle blue sensitive layer) | | |
| Silver halide emulsion (D) | (Ag) | 0.40 |
| Sensitizing dye (ExS-7) | | $7.4 \times 10^{-5}$ |
| Cyan coupler (ExC-7) | | $7.0 \times 10^{-3}$ |

-continued

| | | |
|---|---|---|
| Yellow coupler (ExY-2) | | 0.050 |
| Yellow coupler (ExY-3) | | 0.10 |
| High boiling point organic solvent (HBS-1) | | 0.050 |
| Gelatin | | 0.78 |
| The thirteenth layer (High blue sensitive layer) | | |
| Silver halide emulsion (F) | (Ag) | 1.00 |
| Sensitizing dye (ExS-7) | | $4.0 \times 10^{-4}$ |
| Yellow coupler (ExY-2) | | 0.10 |
| Yellow coupler (ExY-3) | | 0.10 |
| High boiling point organic solvent (HBS-1) | | 0.070 |
| Gelatin | | 0.86 |
| The fourteenth layer (first protective layer) | | |
| Silver halide emulsion (G) | (Ag) | 0.20 |
| Ultraviolet absorbent (UV-4) | | 0.11 |
| Ultraviolet absorbent (UV-5) | | 0.17 |
| High boiling point organic solvent (HBS-1) | | $5.0 \times 10^{-2}$ |
| Gelatin | | 1.00 |
| The fifteenth layer (second protective layer) | | |
| Hardening agent (H-1) | | 0.40 |
| Additive (B-1) (particle diameter: 1.7 μm) | | $5.0 \times 10^{-2}$ |
| Additive (B-2) (particle diameter: 1.7 μm) | | 0.10 |
| Additive (B-3) | | 0.10 |
| Stabilizer (S-1) | | 0.20 |
| Gelatin | | 1.20 |

Further, the following additives (W-1) to (W-3), (B-4) to (B-6), (F-1) to (F-17), an iron salt, a lead salt, a gold salt, a platinum salt, an iridium salt and a rhodium salt were optionally added to each of the layers to improve the stability, handling, pressure-resistance, antimicrobial or antibacterial property, antistatic property and coating property of the layers.

The compounds used in preparation of the photographic material are shown below.

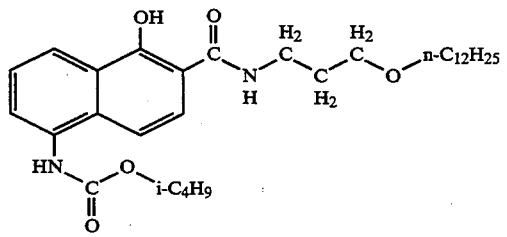

(ExC-1)

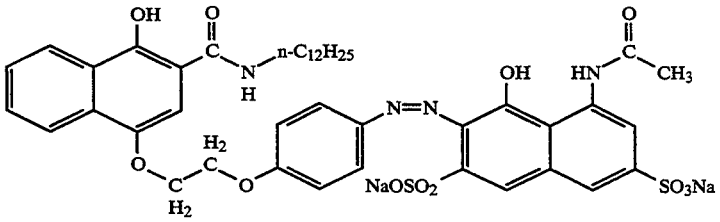

(ExC-2)

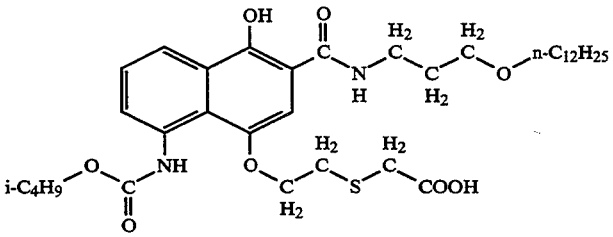

(ExC-3)

-continued
(ExC-4)
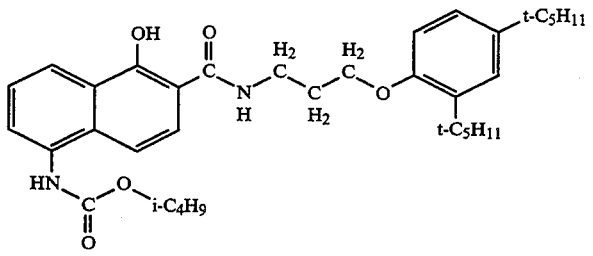
(ExC-5)
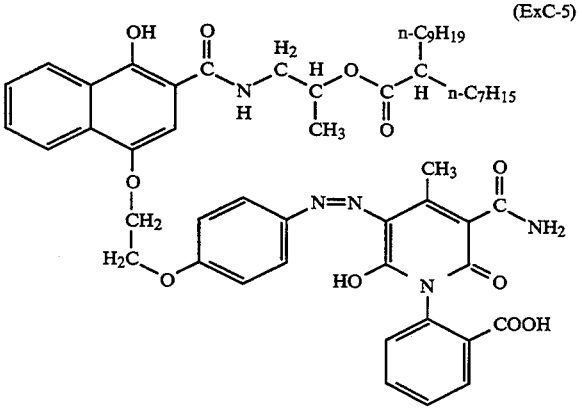
(ExC-6)
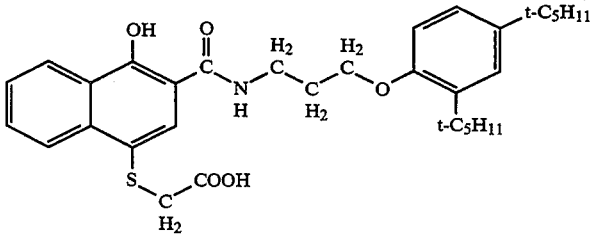
(ExC-7)
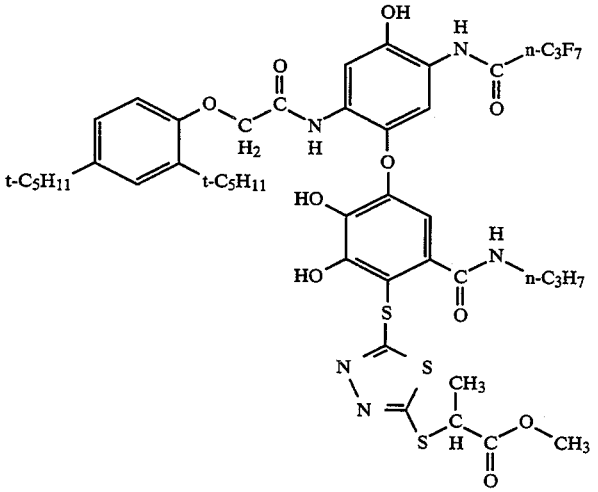
(ExC-8)
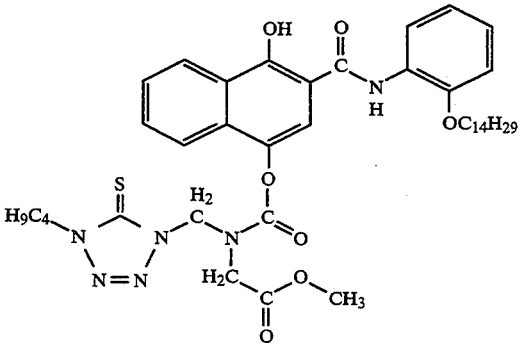

-continued
(ExM-1)
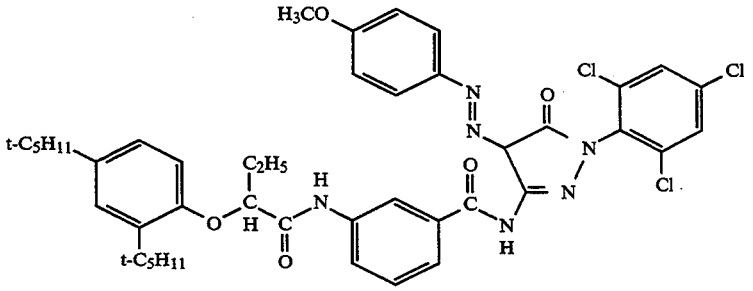
(ExM-2)
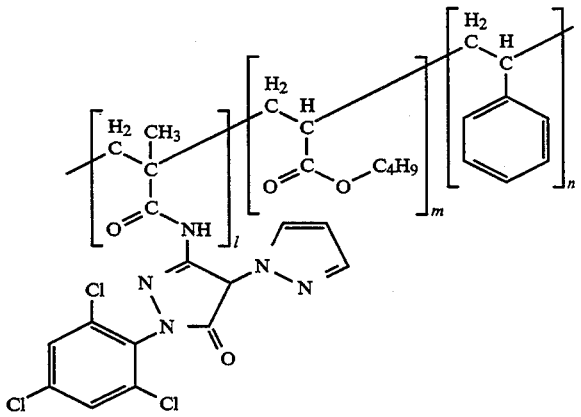
(l = 50, m = 25, n = 25, molecular weight = about 20,000)
(ExM-3)
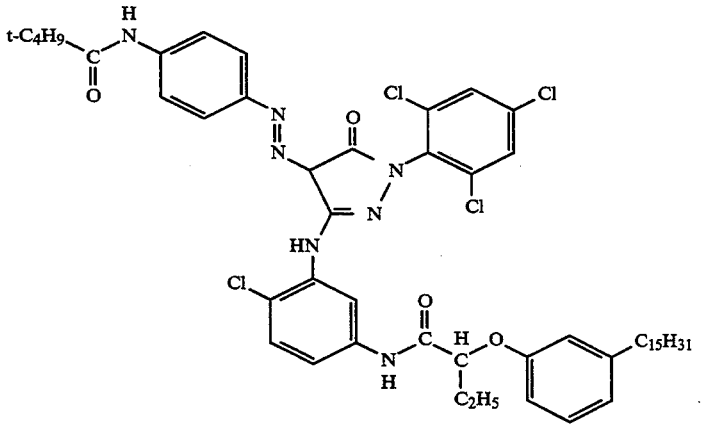
(ExM-4)
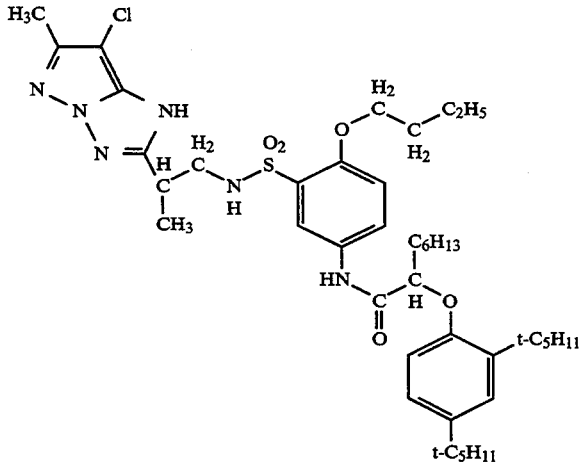

-continued
(ExM-5)
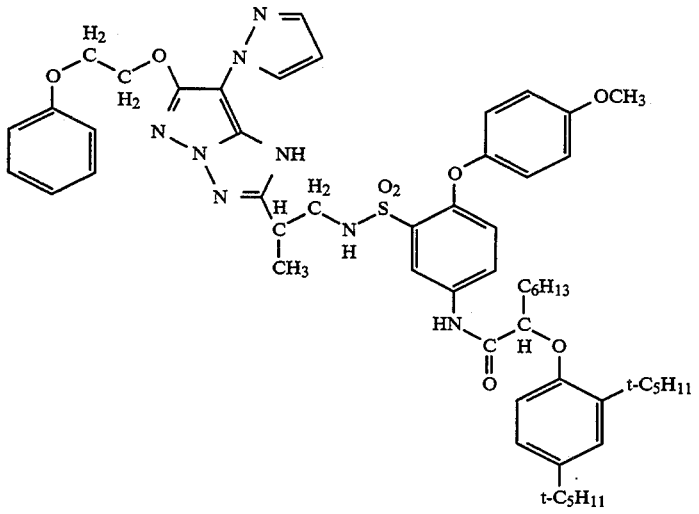
(ExY-1)
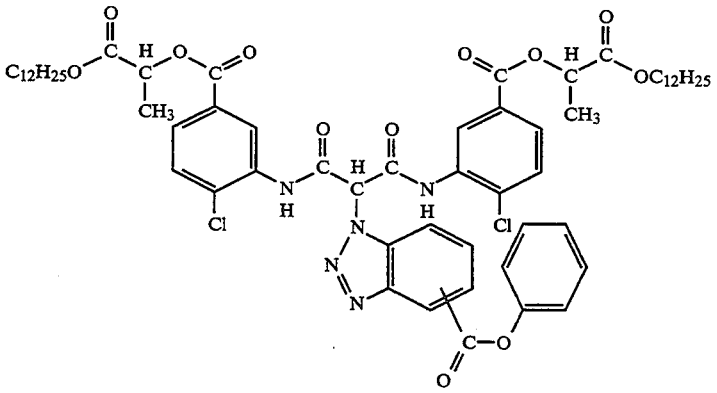
(ExY-2)
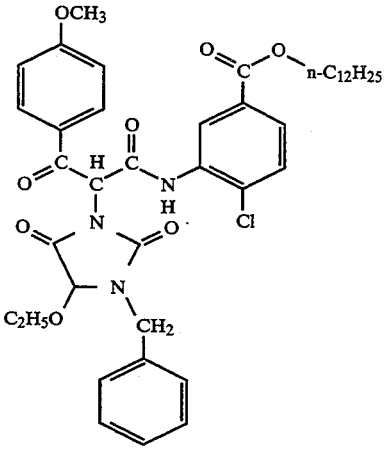
(ExY-3)
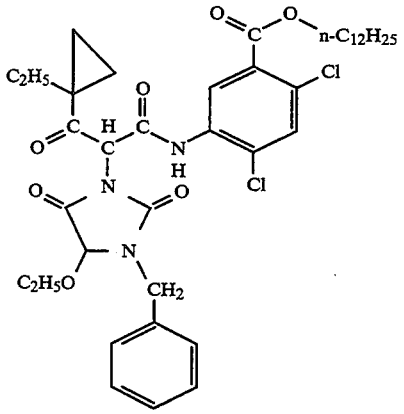

-continued
(ExY-4)
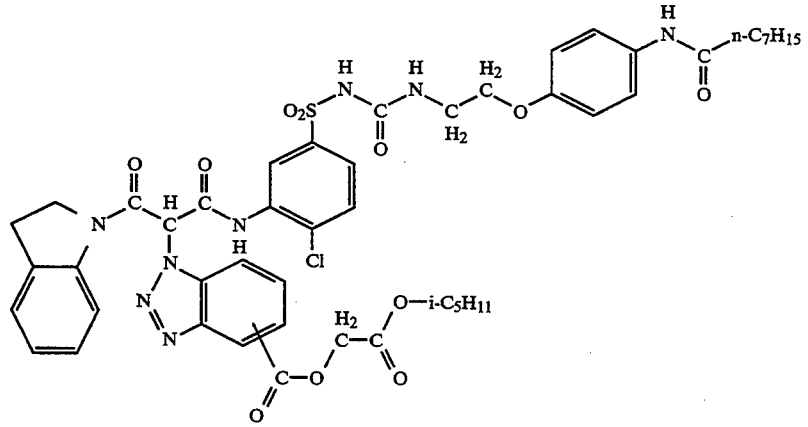
(ExF-1)
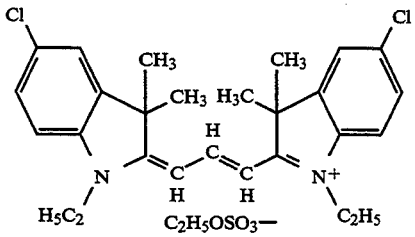
(Cpd-1)
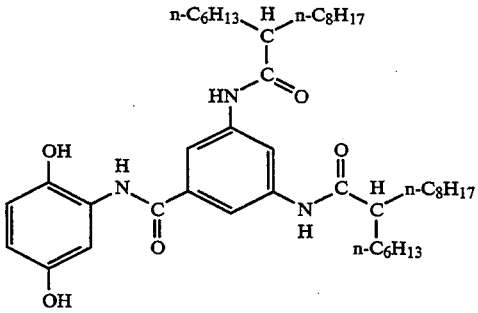
(Cpd-2)
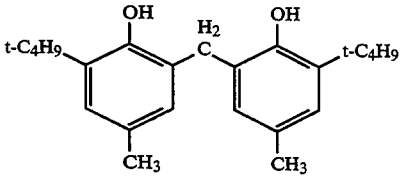
(Cpd-3)
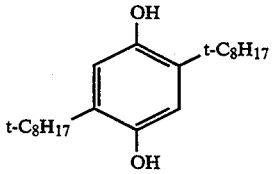
(UV-1)
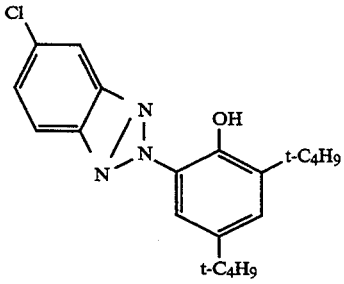
(UV-2)
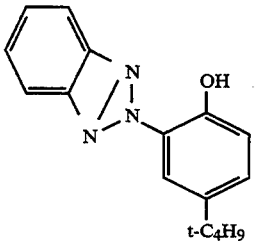
(UV-3)
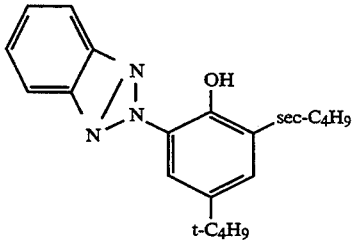
(UV-4)
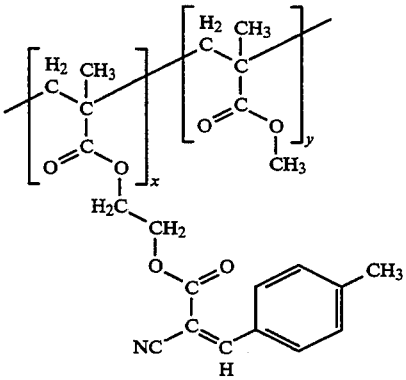
(x:y = 70:30, wt. %)

-continued
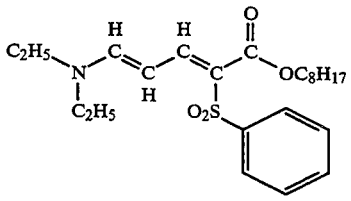
(UV-5)
Tricresyl phosphate (HBS-1)
Di-n-butyl phthalate (HBS-2)
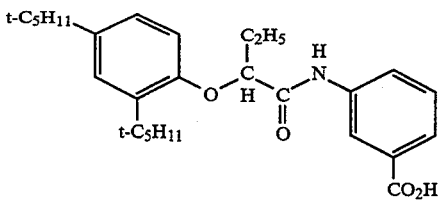
(HBS-3)
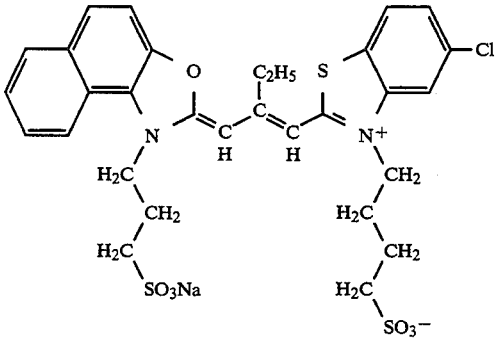
(ExS-1)
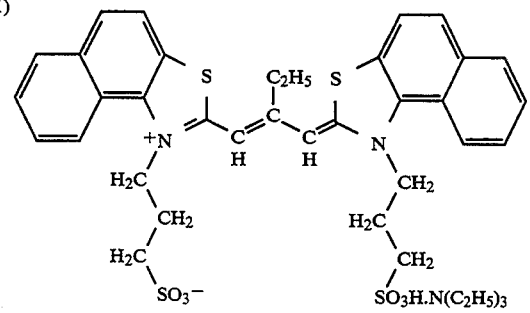
(ExS-2)
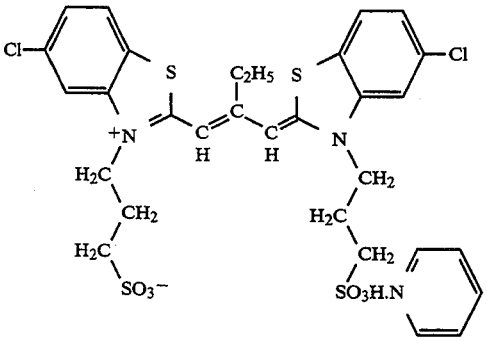
(ExS-3)
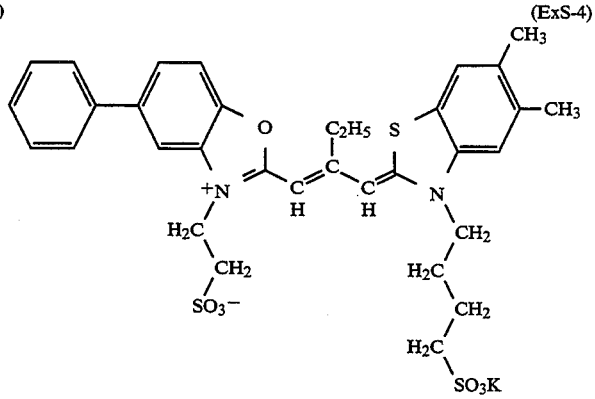
(ExS-4)
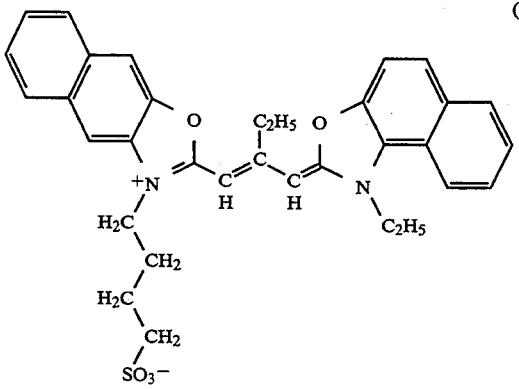
(ExS-5)
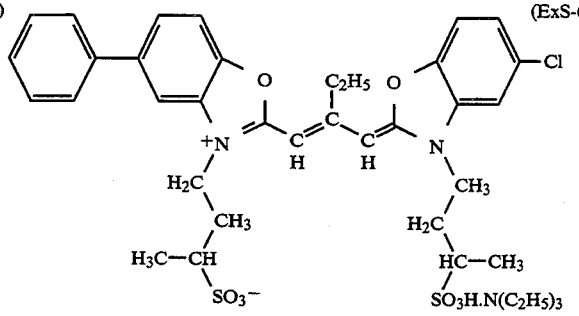
(ExS-6)

-continued
(ExS-7)
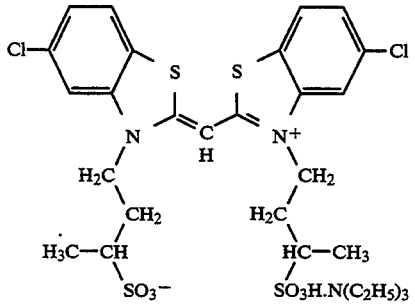
(S-1)
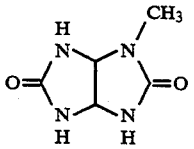
(H-1)
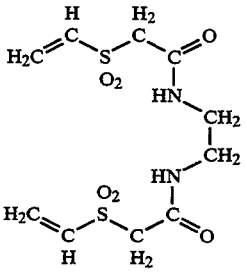
(B-1)
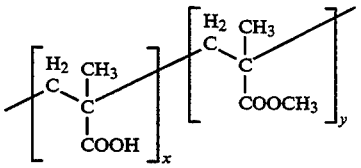
(x:y = 10:90)
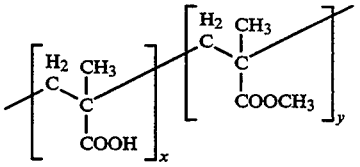
(x:y = 40:60)
(B-2)
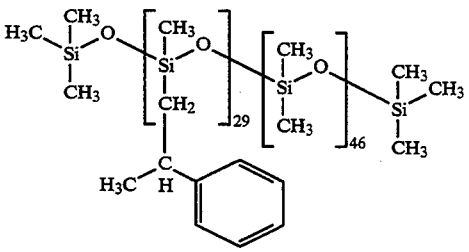
(B-3)
(B-4)
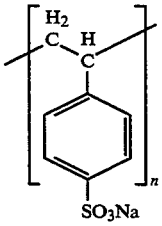
(B-5)
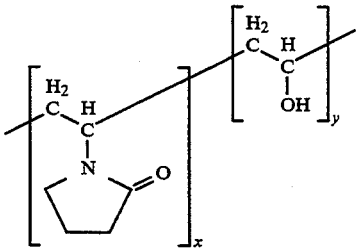
(x:y = 70:30)
(B-6)
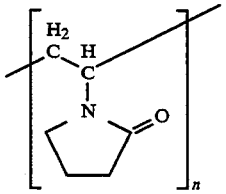
(Molecular weight is about 10,000.)
(W-1)
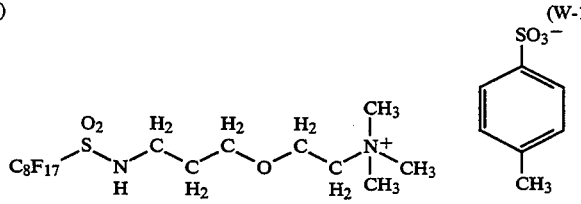
(W-3)
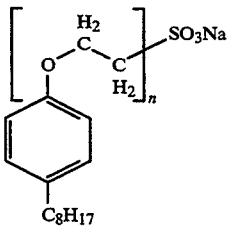
(n = 2 to 4)
(W-3)
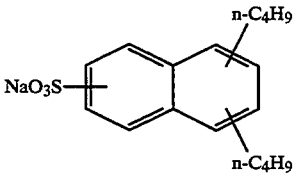

-continued
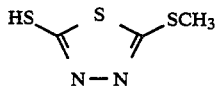
(F-1)
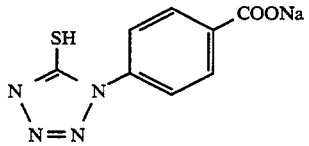
(F-2)
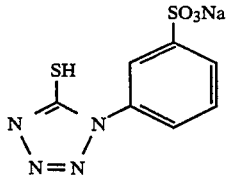
(F-3)
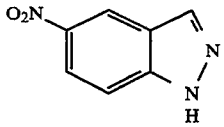
(F-4)
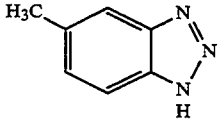
(F-5)
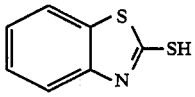
(F-6)
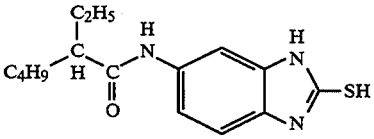
(F-7)
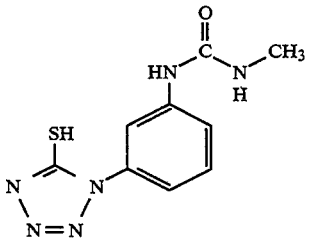
(F-8)
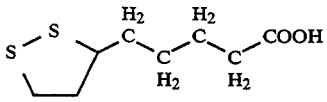
(F-9)
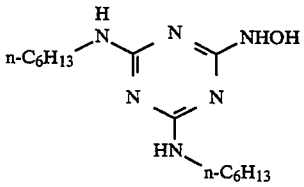
(F-10)
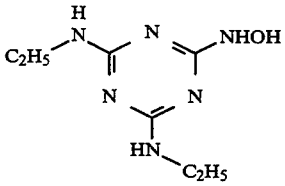
(F-11)
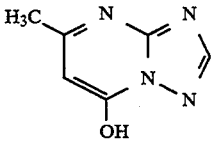
(F-12)
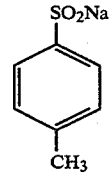
(F-13)
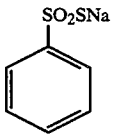
(F-14)
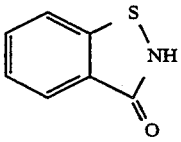
(F-15)
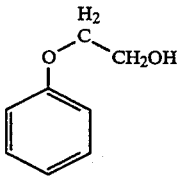
(F-16)

-continued

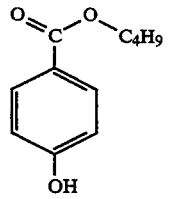

(F-17)

Each of the samples was exposed to light through an optical wedge and a yellow filter for 1/100 second. The samples were developed in the same manner as in the color development of the Example 2, except that the color developing time was changed to 3 minutes and 15 seconds. Then, the cyan color densities of the samples were measured to determine the spectral sensitivities. The results are set forth in Table 6.

In Table 4, the sensitivity is a relative reciprocal value of the exposure required to obtain the maximum cyan color density minus 0.5, which corresponds to the density of the emulsion (A). The relative value is defined in the manner that the value of the sample No. 90 is 100. The amounts of the sensitizers means a mole amount based on 1 mole of silver halide.

TABLE 6

| Sample No. | Sensitizers (amount) (A) | (H) | (I-1) | Spectral sensitivity |
|---|---|---|---|---|
| 90 | $2.7 \times 10^{-5}$ | $9 \times 10^{-6}$ | — | 100 |
| 91 | $1.8 \times 10^{-5}$ | $9 \times 10^{-5}$ | $9 \times 10^{-6}$ | 117 |

Comparative sensitizer (A)

Sodium thiosulfate

Comparative sensitizer (H)

Bis(pentafluorophenyl)phenylphosphine selenide

As is evident from the results set forth in Table 5, the sample (No. 91) of the present invention using the tellurium sensitizer shows a high spectral sensitivity within the red light region.

We claim:

1. A silver halide photographic material which comprises a silver halide emulsion layer provided on a support, wherein the silver halide emulsion layer contains a tellurium compound represented by the formula (I):

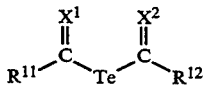

(I)

in which each of $R^{11}$ and $R^{12}$ independently is $—OR^{13}$, $—NR^{14}R^{15}$, $—SR^{16}$ or hydrogen; $R^{11}$ and $R^{12}$ may be combined with each other to form a heterocyclic ring; each of $X^1$ and $X^2$ independently is oxygen, sulfur or $=NR^{17}$; each of $R^{13}$, $R^{14}$, $R^{15}$, $R^{16}$ and $R^{17}$ independently is an alkyl group, an alkenyl group, an alkynyl group, an aralkyl group, an aryl group, a heterocyclic group or hydrogen; R14 and R15 may be combined with each other to form a heterocyclic ring; and each of the alkyl group, the alkenyl group, the alkynyl group, the aralkyl group, the aryl group and the heterocyclic group may have one or more substituent groups.

2. The photographic material as claimed in claim 1, wherein each of $R^{11}$ and R12 in the formula (I) independently is $—OR^{13}$ or $—NR^{14}R^{15}$.

3. The photographic material as claimed in claim 1, wherein each of $R^{11}$ and $R^{12}$ in the formula (I) independently is $—NR^{14}R^{15}$.

4. The photographic material as claimed in claim 1, wherein $R^{11}$ and $R^{12}$ in the formula (I) are identical.

5. The photographic material as claimed in claim 1, wherein each of $X^1$ and $X^2$ in the formula (I) independently is oxygen or sulfur.

6. The photographic material as claimed in claim 1, wherein each of $X^1$ and $X^2$ in the formula (I) is oxygen.

7. The photographic material as claimed in claim 1, wherein each of $R^{13}$, $R^{14}$, $R^{15}$, $R^{16}$ and $R^{17}$ in the formula (I) independently is an alkyl group, an aryl group or a heterocyclic group.

8. The photographic material as claimed in claim 1, wherein the tellurium compound represented by the formula (I) is contained in an amount of $10^{-8}$ to $10^{-2}$ mol based on 1 mol of the silver halide.

9. A silver halide photographic material which comprises a silver halide emulsion layer provided on a support, wherein the silver halide emulsion layer contains a tellurium compound represented by the formula (II):

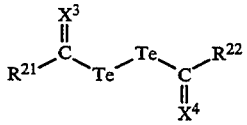

(II)

in which each of $R^{21}$ and $R^{22}$ independently is an alkyl group, an alkenyl group, an alkynyl group, an aralkyl group, an aryl group, a heterocyclic group, $—OR^{23}$, $—NR^{24}R^{25}$, $—SR^{26}$ or hydrogen; $R^{21}$ and $R^{22}$ may be combined with each other to form a heterocyclic ring; each of $X^3$ and $X^4$ independently is oxygen, sulfur or $=NR^{27}$; each of $R^{23}$, $R^{24}$, $R^{25}$, $R^{26}$ and $R^{27}$ independently is an alkyl group, an alkenyl group, an alkynyl group, an aralkyl group, an aryl group, a heterocyclic group or hydrogen; $R^{24}$ and $R^{25}$ may be combined with each other to form a heterocyclic ring; and each of the alkyl group, the alkenyl group, the alkynyl group, the aralkyl group, the aryl group and the heterocyclic group may have one or more substituent groups.

10. The photographic material as claimed in claim 9, wherein each of $R^{21}$ and $R^{22}$ in the formula (II) independently is $—OR^{23}$, $—NR^{24}R^{25}$, $—SR^{26}$ or hydrogen.

11. The photographic material as claimed in claim 9, wherein each of $R^{21}$ and $R^{22}$ in the formula (II) independently is $—OR^{23}$ or $—NR^{24}R^{25}$.

12. The photographic material as claimed in claim 9, wherein each of $R^{21}$ and $R^{22}$ in the formula (II) independently is $—NR^{24}R^{25}$.

13. The photographic material as claimed in claim 9, wherein $R^{21}$ and $R^{22}$ in the formula (II) are identical.

14. The photographic material as claimed in claim 9, wherein each of $X^3$ and $X^4$ in the formula (II) independently is oxygen or sulfur.

15. The photographic material as claimed in claim 9, wherein each of $X^3$ and $X^4$ in the formula (II) is oxygen.

16. The photographic material as claimed in claim 9, wherein each of $R^{23}$, $R^{24}$, $R^{25}$, $R^{26}$ and $R^{27}$ in the formula (II) independently is an alkyl group, an aryl group or a heterocyclic group.

17. The photographic material as claimed in claim 9, wherein the tellurium compound represented by the formula (II) is contained in an amount of $10^{-8}$ to $10^{-2}$ mol based on 1 mol of the silver halide.

* * * * *